US010429788B2

(12) United States Patent
Morishita et al.

(10) Patent No.: US 10,429,788 B2
(45) Date of Patent: Oct. 1, 2019

(54) TONER CASE AND IMAGE FORMING APPARATUS INCLUDING THE SAME

(71) Applicant: KYOCERA Document Solutions Inc., Osaka-shi, Osaka (JP)

(72) Inventors: Hiroki Morishita, Osaka (JP); Atsuhiro Wakimoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 63 days.

(21) Appl. No.: 15/798,087

(22) Filed: Oct. 30, 2017

(65) Prior Publication Data

US 2018/0120730 A1 May 3, 2018

(30) Foreign Application Priority Data

Oct. 31, 2016 (JP) ..... 2016-213280

(51) Int. Cl.

| | |
|---|---|
| ***G03G 15/08*** | (2006.01) |
| ***G03G 15/00*** | (2006.01) |
| ***G03G 15/04*** | (2006.01) |
| ***G03G 15/043*** | (2006.01) |

(52) U.S. Cl.

CPC ..... *G03G 15/556* (2013.01); *G03G 15/043* (2013.01); *G03G 15/04054* (2013.01); *G03G 15/087* (2013.01); *G03G 15/5016* (2013.01); *G03G 15/0863* (2013.01); *G03G 15/0886* (2013.01)

(58) Field of Classification Search

CPC .... G03G 15/55; G03G 15/553; G03G 15/556; G03G 21/1875; G03G 21/1892; G03G 21/1896; G03G 2221/1663

See application file for complete search history.

(56) References Cited

U.S. PATENT DOCUMENTS 5,530,531 A * 6/1996 Girard ..... B41J 2/1755 222/DIG. 1

2014/0334834 A1 11/2014 Katsuyama

FOREIGN PATENT DOCUMENTS

| | | | |
|---|---|---|---|
| JP | 60133461 U | | 9/1985 |
| JP | 2004085887 A | * | 3/2004 |
| JP | 2008076837 A | * | 4/2008 |
| JP | 2014238566 A | | 12/2014 |
| JP | 2016118624 A | | 6/2016 |

OTHER PUBLICATIONS

JP 2008076837 English machine translation, Mitsunaga, Apr. 3, 2008 (Year: 2008).*

JP 2004085887 English machine translation, Ishii et al., Mar. 18, 2004 (Year: 2004).*

Japanese Patent Office, Office Action Issued in Application No. 2016213280, Jul. 2, 2019, 4 pages.

* cited by examiner

*Primary Examiner* — Thomas S Giampaolo, II

(74) *Attorney, Agent, or Firm* — Alleman Hall Creasman & Tuttle LLP

(57) ABSTRACT

A toner case is attached to a case attachment portion of an image forming apparatus. The toner case includes a case main body and a deflection portion. Toner is stored in the case main body. The deflection portion receives light that has been emitted from the case attachment portion toward the case main body, and deflects the light outward.

12 Claims, 23 Drawing Sheets

TONER CASE AND IMAGE FORMING APPARATUS INCLUDING THE SAME

INCORPORATION BY REFERENCE

This application is based upon and claims the benefit of priority from the corresponding Japanese Patent Application No. 2016-213280 filed on Oct. 31, 2016, the entire contents of which are incorporated herein by reference.

BACKGROUND

The present disclosure relates to a toner case configured to store toner therein, and an image forming apparatus including a toner case.

A developing device is installed in an image forming apparatus such as a copier, a printer or the like that forms an image on a print sheet by the electrophotography. The toner inside the developing device is decreased as the developing device performs the developing. As a result, the image forming apparatus is configured such that a toner case storing toner is attached thereto in a detachable manner. The toner is supplied from a toner storage chamber in the toner case to the developing device in a state where the toner case is attached to the image forming apparatus. The toner case includes a toner discharge port and an opening/closing member, wherein the toner discharge port is provided to discharge the toner to the outside, and the opening/closing member is provided to open and close the toner discharge port. When an operation lever, which is attached to the toner case or an apparatus main body, is operated, the opening/closing member is displaced from a closing position to an opening position. This allows the toner discharge port to be opened, and the toner is discharged from the toner storage chamber to the outside. It is noted that when the toner in the toner case is consumed and the toner case becomes empty, the toner case is replaced with a new toner case filled with toner.

There is known an image forming apparatus of this type which, when an error such as a paper jam occurs, lights a light-emitting member provided on an outside of the apparatus so as to let the user know a place where the error has occurred.

SUMMARY

A toner case according to an aspect of the present disclosure is attached to a case attachment portion of an image forming apparatus. The toner case includes a case main body and a deflection portion. Toner is stored in the case main body. The deflection portion receives light that has been emitted from the case attachment portion toward the case main body, and deflects the light outward.

An image forming apparatus according to another aspect of the present disclosure includes an apparatus main body, a case attachment portion, and a light emitting member. The case attachment portion is provided in the apparatus main body, and the toner case is attached to the case attachment portion in a detachable manner. The light emitting member emits light to the deflection portion of the toner case in a state where the toner case is attached to the case attachment portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1A:
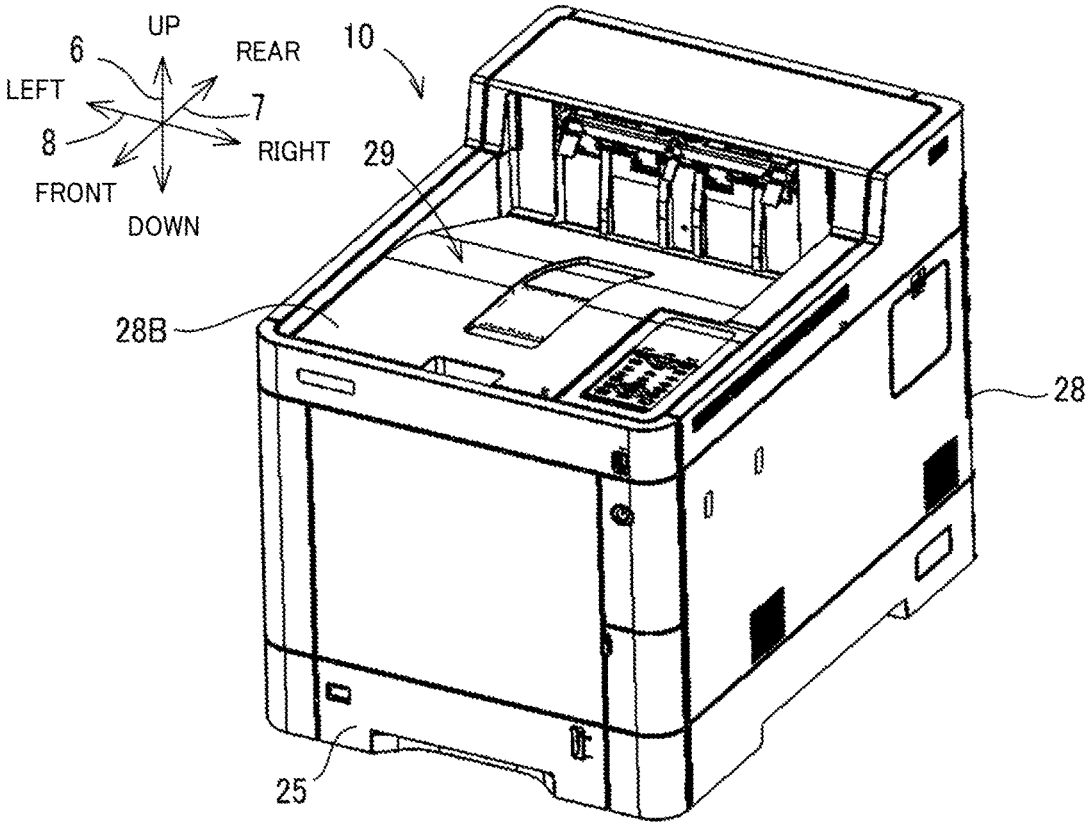
FIG. 1A and FIG. 1B are perspective diagrams showing a configuration of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. It is noted that for the sake of explanation, a vertical direction in an installment state where an image forming apparatus 10 is installed in a usable manner (the state shown in FIG. 1) is defined as an up-down direction 6. In addition, a front-rear direction 7 is defined on a basis that a side at which a sheet feed device 25 shown in FIG. 1 is inserted and drawn out in the installment state, is a front side (front). Furthermore, a left-right direction 8 is defined based on the front side of the image forming apparatus 10 in the installment state.

[Image Forming Apparatus 10]

The image forming apparatus 10 according to the embodiment of the present disclosure has at least a print function. The image forming apparatus 10 is a so-called tandem-type color printer. Of course, the image forming apparatus 10 is not limited to one that forms a color image, but may be one that forms a monochrome image.

Figure 1B:
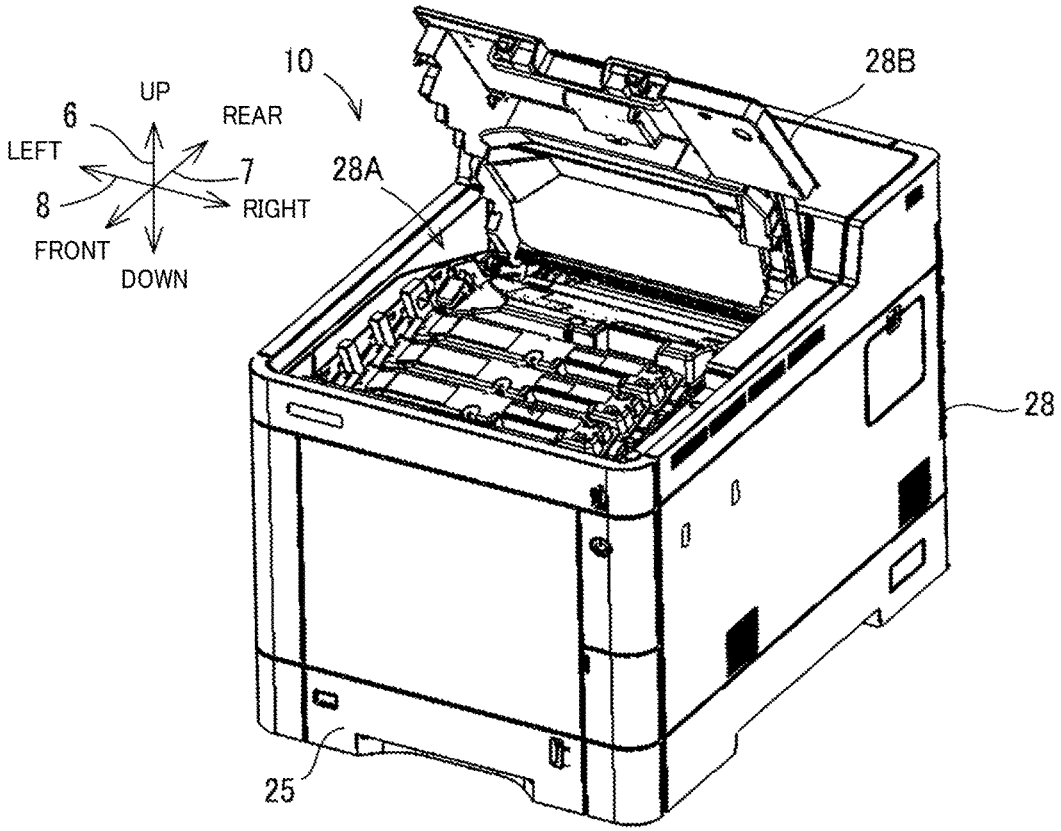
Figure 2:
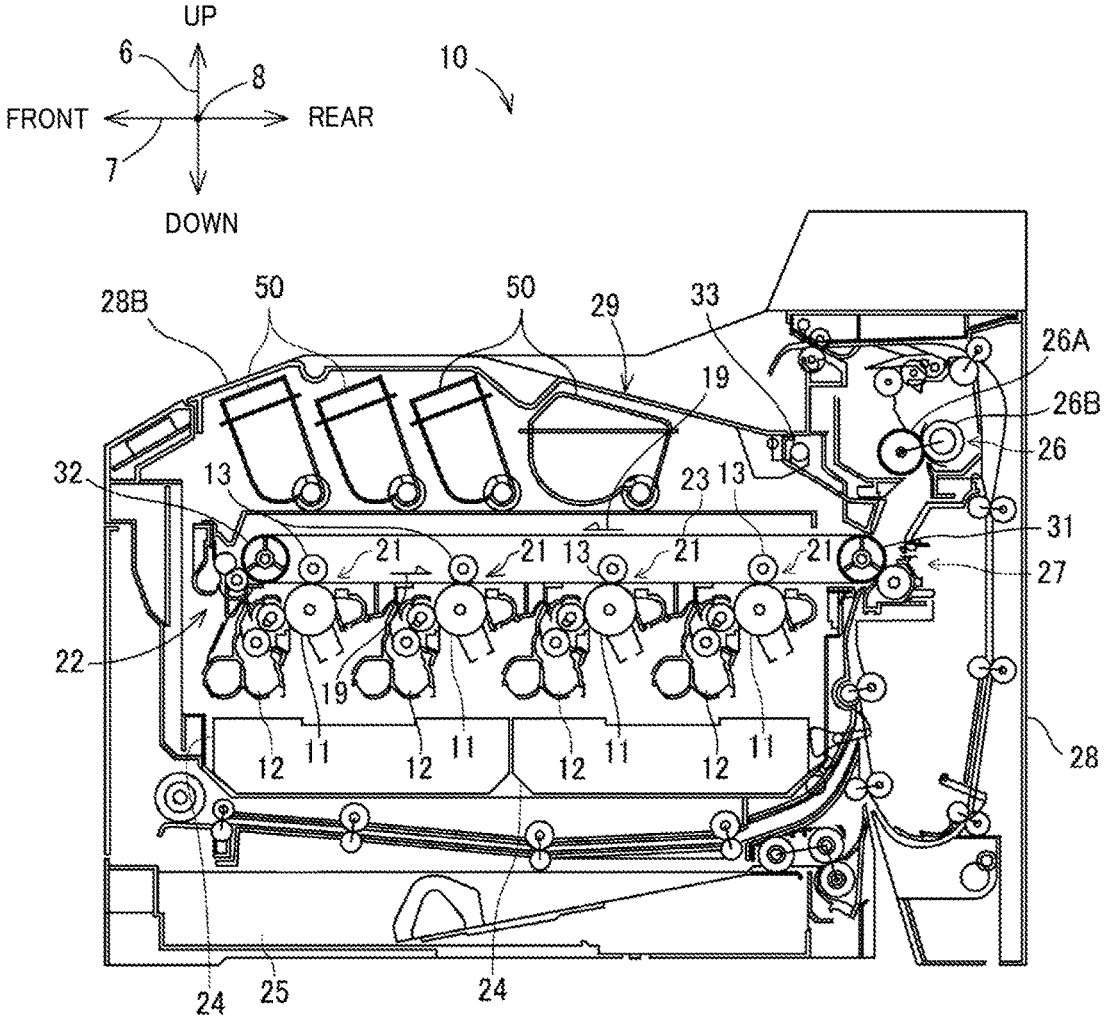
FIG. 2 is a cross-sectional diagram showing an internal configuration of the image forming apparatus.

As shown in FIG. 1A, FIG. 1B, and FIG. 2, the image forming apparatus 10 includes an apparatus main body 28. The apparatus main body 28 has an approximately rectangular parallelpiped shape as a whole. The apparatus main body 28 is a housing including an external frame, an internal frame, and an exterior panel of the image forming apparatus 10. Components of the image forming apparatus 10 are disposed in the apparatus main body 28. As shown in FIG. 1B, in an upper surface of the apparatus main body 28, an opening 28A (an example of the upper-surface opening) is formed. In addition, at the upper surface of the apparatus main body 28, a top cover 28B (an example of the cover member) that opens and closes the opening 28A is provided.

As shown in FIG. 2, the image forming apparatus 10 includes, as major components, four image forming portions 21, an intermediate transfer unit 22, the sheet feed device 25, a fixing device 26, a secondary transfer device 27, two exposure devices 24, four toner containers 50 (50A-50D), and an attachment portion 40 (an example of the case attachment portion). These components are disposed in the apparatus main body 28 of the image forming apparatus 10. It is noted that the toner containers 50 are an example of the toner case in the image forming apparatus 10.

As shown in FIG. 2, the four image forming portions 21 are disposed below the intermediate transfer unit 22 in the apparatus main body 28. The image forming portions 21 are aligned along the front-rear direction 7. The image forming portions 21 execute an image formation process of forming an image corresponding to image data on a print sheet based on a so-called electrophotography. Each of the image forming portions 21 includes a photoconductor drum 11, a charging device (not shown), a developing device 12, and a primary transfer device 13. The image forming portions 21 form toner images respectively on the photoconductor drums 11, and transfer the toner images to a transfer belt 23 provided in the intermediate transfer unit 22 by overlaying the toner images onto the belt in sequence. The transfer belt 23 moves (runs) in a direction indicated by the arrow 19, and the toner images are transferred in sequence to the transfer belt 23 while it is moving. In the example shown in FIG. 2, in order from the downstream side in the movement direction of the transfer belt 23 (the direction of the arrow 19), the image forming portions 21 for black, cyan, magenta, and yellow are disposed in a row in the apparatus main body 28.

The intermediate transfer unit 22 is disposed above the image forming portions 21. At opposite ends of the intermediate transfer unit 22 in the front-rear direction 7, a driving pulley 31 and a driven pulley 32 are provided. The transfer belt 23 is supported by the driving pulley 31 and the driven pulley 32 by being suspended therebetween. This allows the transfer belt 23 to extend in the front-rear direction 7, the belt surface extending horizontally. In addition, supported by the driving pulley 31 and the driven pulley 32, the transfer belt 23 can move in the direction indicated by the arrow 19 while its surface is in contact with the surfaces of the photoconductor drums 11. The transfer belt 23 has a shape of an endless ring and is formed from a material such as rubber or urethane.

The secondary transfer device 27 transfers, from the transfer belt 23 to a print sheet, a color toner image formed from toner images of a plurality of colors. The print sheet with the color toner image transferred thereto is conveyed to the fixing device 26. The fixing device 26 fixes the color toner image to the print sheet by applying heat. The fixing device 26 includes a heating roller 26A and a pressure roller 26B. The heating roller 26A is heated to a high temperature. The collection roller 62B is disposed to face the heating roller 26A. In the fixing device 26, the print sheet is passed through a nip portion where it is conveyed while nipped by a predetermined biasing force between the heating roller 26A and the pressure roller 26B. This allows the color toner image to be fused and adhered to the print sheet. A sheet discharge tray 29 is provided on the upper surface of the top cover 28B of the apparatus main body 28. The print sheet with the color toner image fixed thereto is discharged onto the sheet discharge tray 29.

It is noted that the image forming apparatus 10 may have a configuration where the transfer belt 23 is used as a conveyance belt for conveying a print sheet, and the toner images are overlaid directly on a print sheet that is being conveyed on the conveyance belt so that the toner images are transferred to the print sheet. In addition, the image forming apparatus 10 may have a configuration where an intermediate transfer member in the shape of a roller is used in place of the transfer belt 23.

The four toner containers 50 (50A-50D) are attached to the attachment portion 40 in a detachable manner. The four toner containers 50 (50A-50D) are disposed above the intermediate transfer unit 22. Inside the apparatus main body 28, the four toner containers 50 are aligned in a row along the transfer belt 23 in the front-rear direction 7. The toner containers 50 are configured to supply toner to the developing devices 12 of corresponding colors.

The top cover 28B is configured to cover the opening 28A formed on the apparatus main body 28. The top cover 28B is supported so as to pivot around a support shaft 33 (see FIG. 2) provided in the apparatus main body 28. This allows the top cover 28B to pivot between a closing position and an opening position, wherein at the closing position, the top cover 28B covers and closes the opening 28A, and at the opening position, the top cover 28B is away from and opens the opening 28A.

Figure 3A:
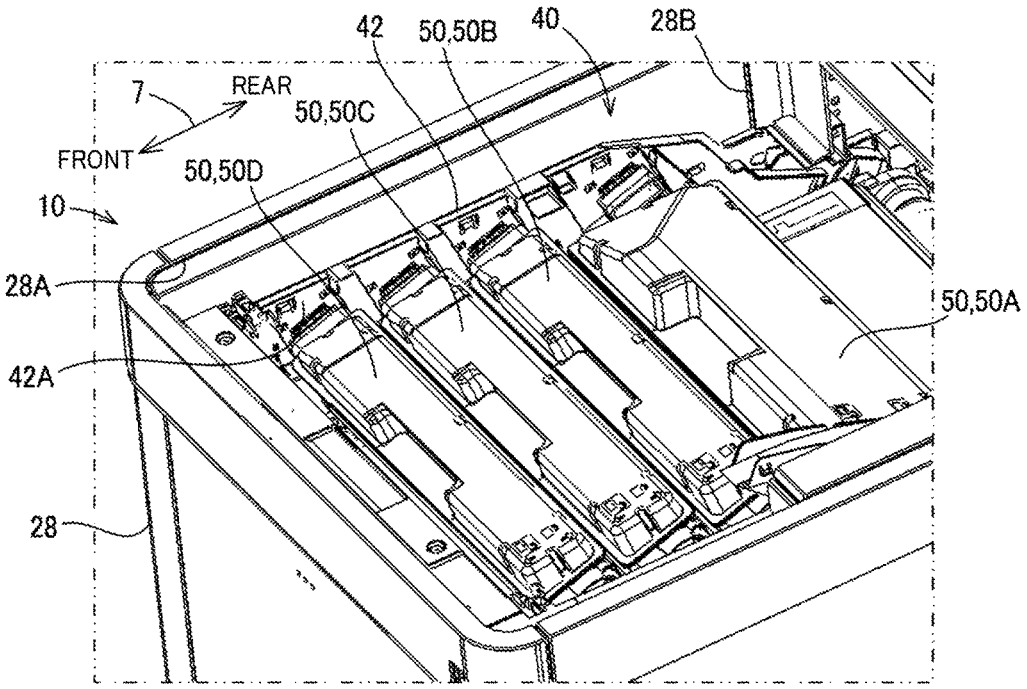
FIG. 3A is a diagram showing an attachment state where toner containers according to the embodiment of the present disclosure are attached to the image forming apparatus.
Figure 3B:
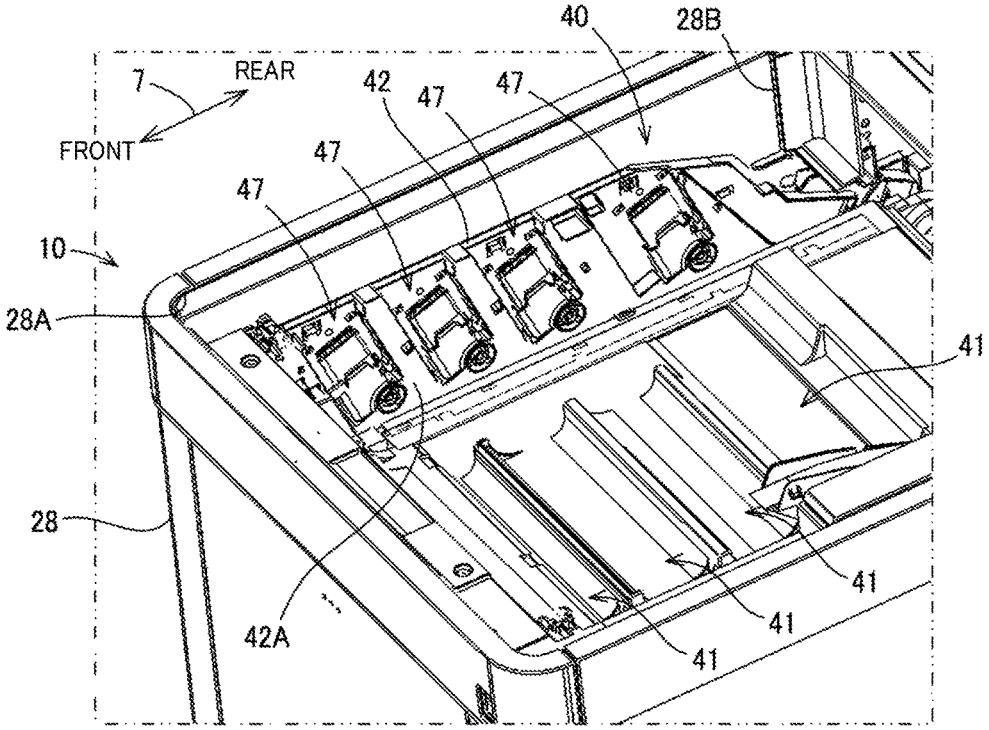
FIG. 3B is a diagram showing an attachment portion in the image forming apparatus to which the toner containers are attached.

The attachment portion 40 is provided for the toner containers 50 to be attached thereto in a detachable manner. As shown in FIG. 3A and FIG. 3B, the attachment portion 40 is provided in the apparatus main body 28. Specifically, the attachment portion 40 is provided between the top cover 28B and the intermediate transfer unit 22. When the top cover 28B is pivoted upward (in the opening direction), the attachment portion 40 is exposed. The attachment portion 40 is integrally formed with an upper part of the intermediate transfer unit 22. When attached to the attachment portion 40, the toner containers 50 are inserted in the attachment portion 40 in a state where the top cover 28B is opened. The attachment portion 40 has four storage spaces 41, and the toner containers 50 are attached to the attachment portion 40 in a state of being stored in the storage spaces 41 respectively. It is noted that the attachment portion 40 is not limited to the one integrally formed with the upper part of the intermediate transfer unit 22, but may be provided as a member independent of the intermediate transfer unit 22, in the apparatus main body 28.

The toner containers 50 store toner of different colors that correspond to the colors of the image forming portions 21. Specifically, the toner containers 50 (50A-50D) store toner of black, cyan, magenta, and yellow, respectively. As shown in FIG. 2, FIG. 3A, and FIG. 3B, among the four toner containers 50, the toner container 50A positioned on the most rear side is a large-capacity type and can store a larger amount of toner than the other toner containers 50B-50D. The toner container 50A stores black toner. The toner containers 50B-50D have the same shape and capacity. The toner container 50B stores cyan toner, the toner container 50C stores magenta toner, and the toner container 50D stores yellow toner.

[Configuration of Toner Containers 50]

The following describes the configuration of the toner containers 50. It is noted here that the large-capacity-type toner container 50A and the other toner containers 50B-50D have the same configuration except for the size of the toner storage portion. In addition, the toner containers 50B-50D have the same configuration except for the arrangement position. As a result, in the following description, the toner containers 50A-50D are collectively called "toner container 50".

The toner container 50 has a function to supply toner to the developing device 12. The toner container 50 stores, in its inside, toner to be supplied to the developing device 12. The toner container 50 is supported so as to be attached to the attachment portion 40 (see FIG. 3A) in a detachable manner. The toner container 50 is inserted in the apparatus main body 28 from the opening 28A formed in the upper surface of the apparatus main body 28, and is stored in one of the storage spaces 41 of the attachment portion 40.

Figure 7:
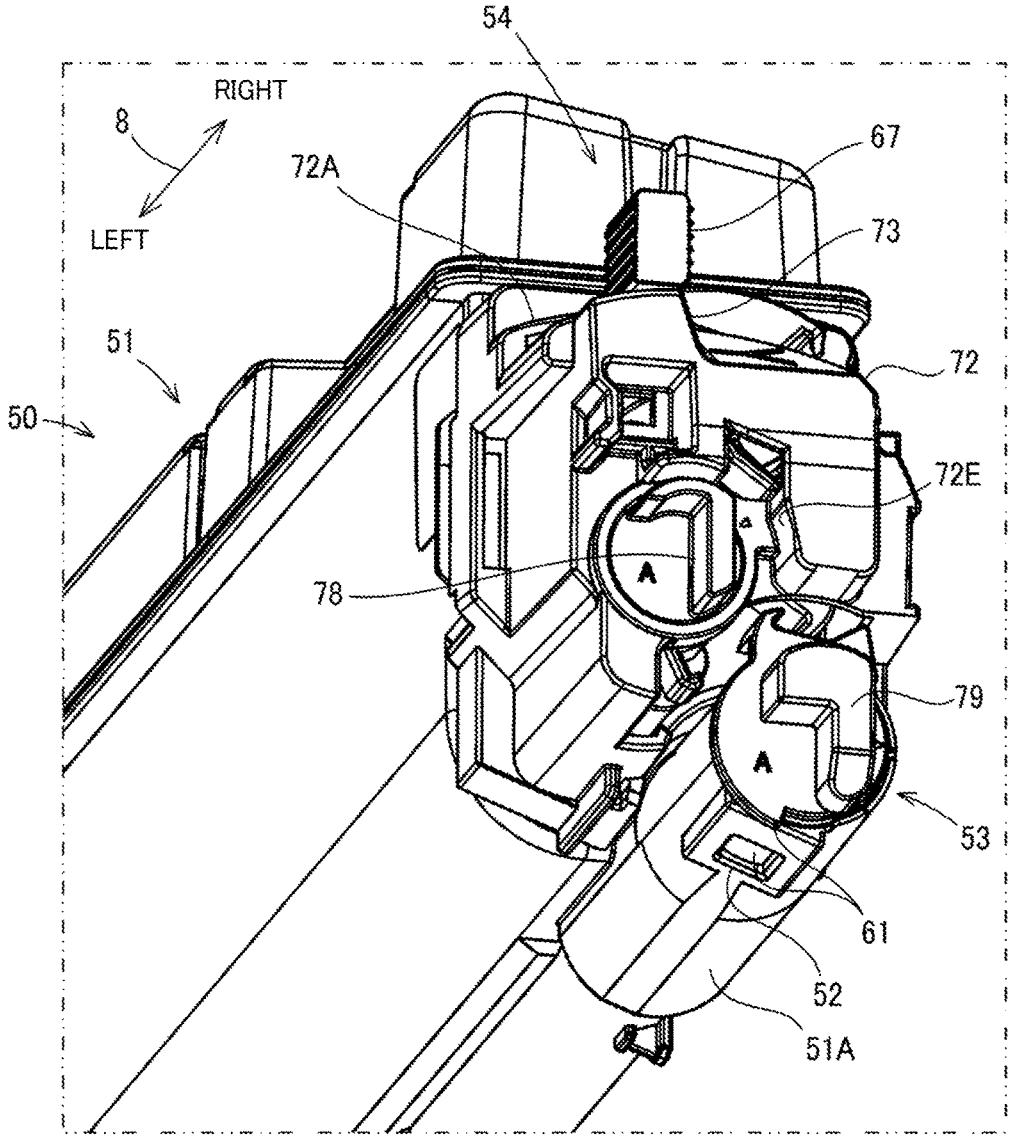
FIG. 7 is a diagram showing a configuration of a right-side end portion of the toner container.
Figure 8:
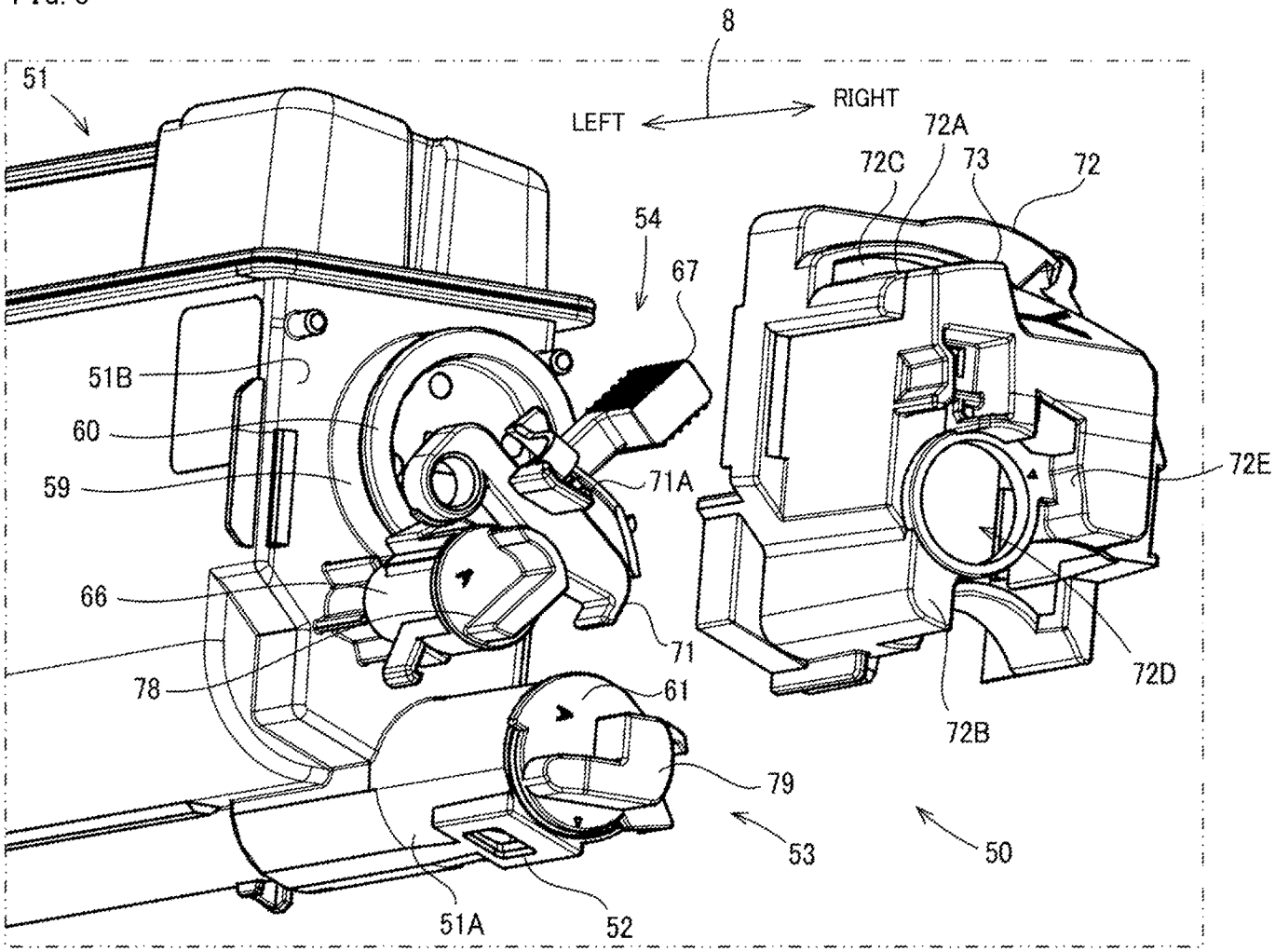
FIG. 8 is a diagram showing a state where a cover at the right-side end portion of the toner container is removed.

As shown in FIG. 4 to FIG. 8, the toner container 50 includes a housing 51 (an example of the case main body), a toner discharge port 52 (see FIG. 7), and an opening/closing mechanism 53 (see FIG. 7), an operation portion 54, and a side cover 72. The housing 51 is attached to the attachment portion 40 of the image forming apparatus 10. The housing 51 is formed from a resin material in the shape of a box that is elongated in the left-right direction 8. That is, the longitudinal direction of the housing 51 matches the left-right direction 8 of the image forming apparatus 10 shown in FIG. 1A. The toner is stored in a storage space provided within the housing 51. As shown in FIG. 7, the toner discharge port 52 is formed in the housing 51. The toner discharge port 52 is formed in a right end portion (one of opposite end portions in the longitudinal direction) of a bottom surface of the housing 51. The toner in the housing 51 is discharged to outside from the toner discharge port 52. In addition, as shown in FIG. 8, the operation portion 54 is provided in the housing 51 such that it can be operated by the user.

Figure 4:
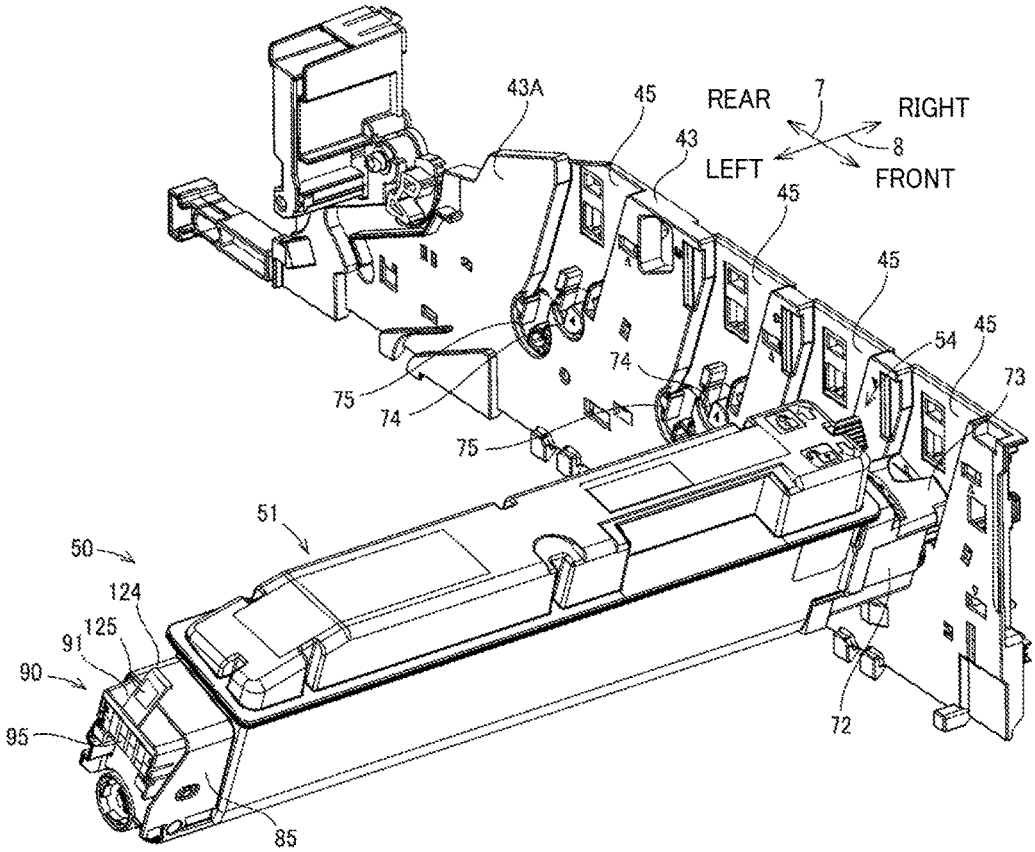
FIG. 4 is a diagram showing a toner container and the attachment portion.

As shown in FIG. 3A, FIG. 3B, and FIG. 4, the attachment portion 40 includes support plates 42 and 43 to which the toner containers 50 are attached. It is noted that the support plate 43 is not shown in FIG. 3A and FIG. 3B, and the support plate 42 is not shown in FIG. 4. The support plates 42 and 43 are each formed in the shape of a plate, and extend in the front-rear direction 7. The support plates 42 are 43 are separated in the left-right direction 8 in the attachment portion 40, and arranged to face each other. As shown in FIG. 3B, the support plate 42 is erected on a left end portion of the attachment portion 40. As shown in FIG. 4, the support plate 43 is erected on a right end portion of the attachment portion 40. In the attachment portion 40, the opposite ends of the four toner containers 50 in the longitudinal direction are respectively supported by the support plates 42 and 43.

Figure 5:
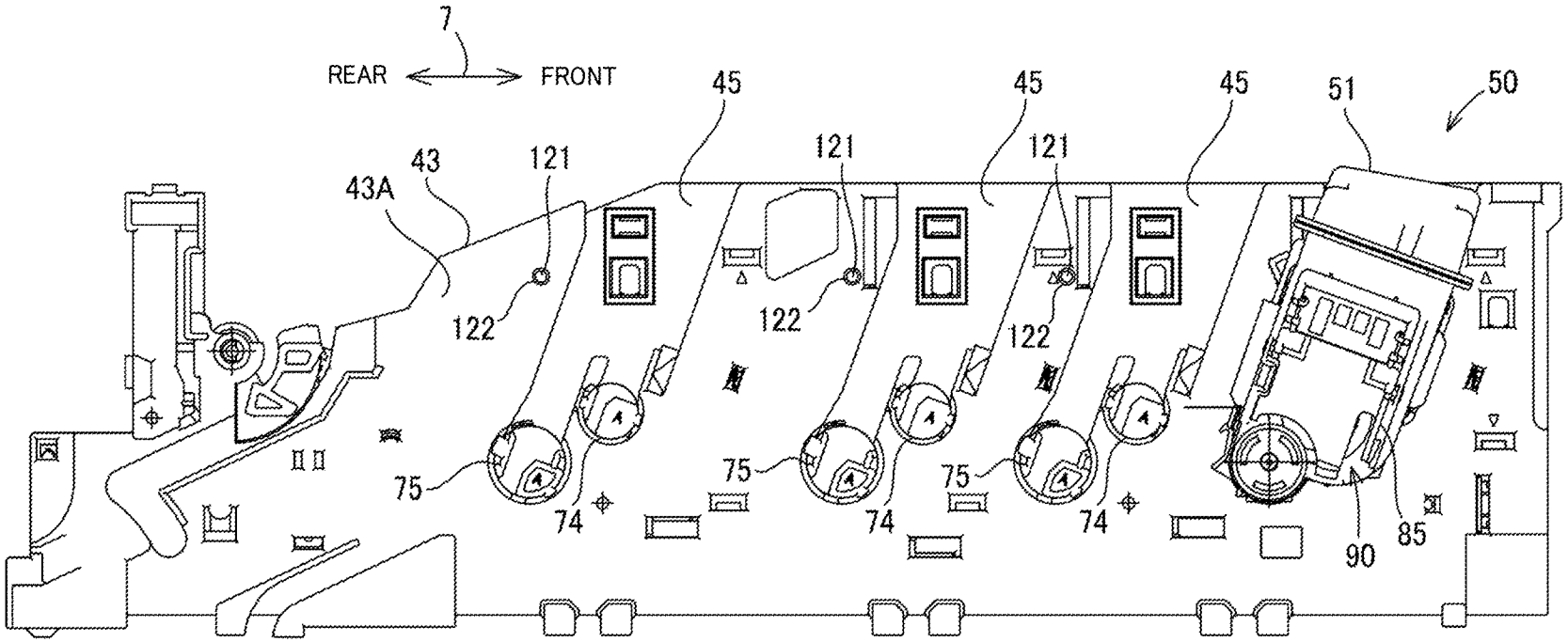
FIG. 5 is a diagram showing a toner container and the attachment portion.
Figure 6:
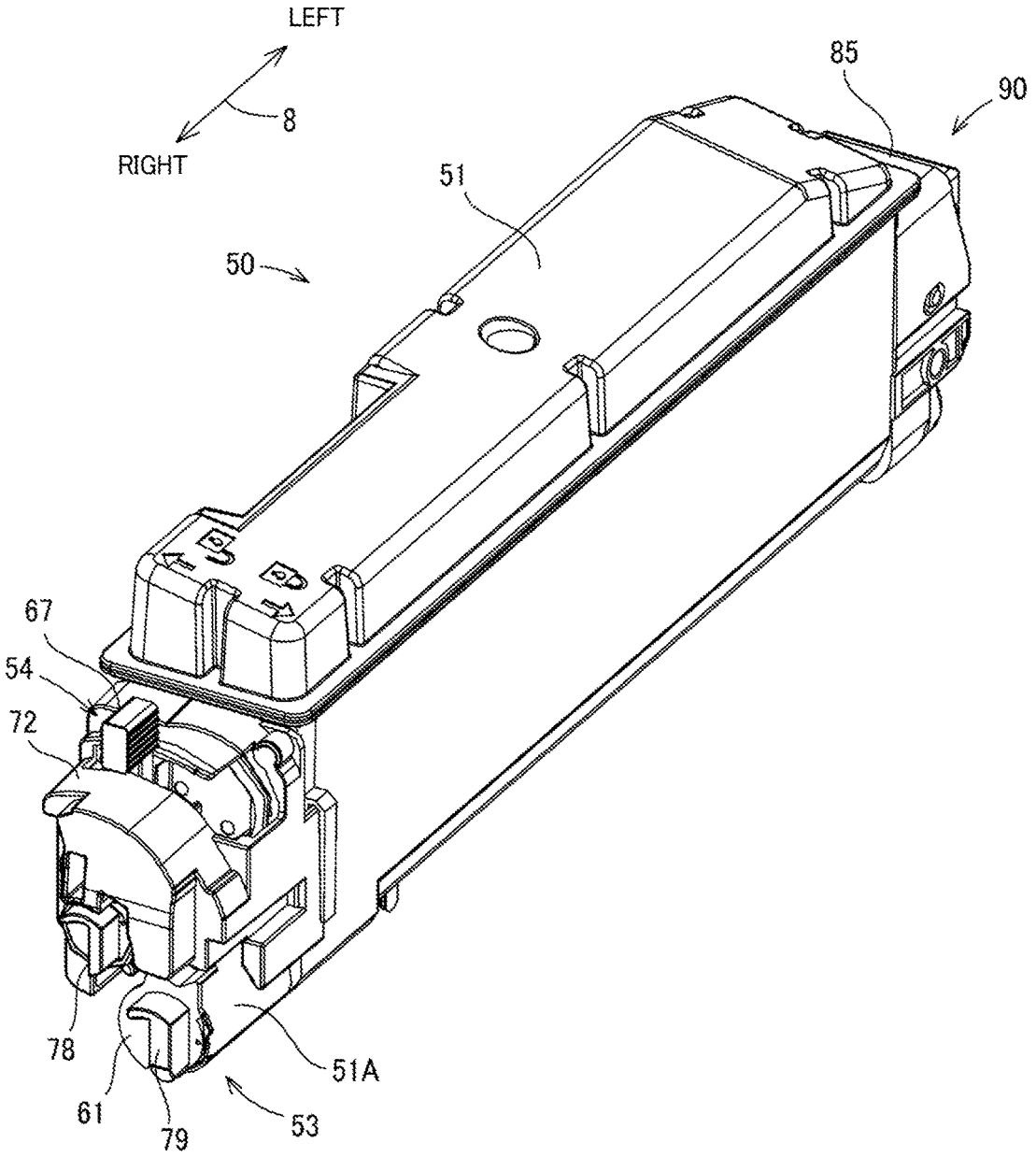
FIG. 6 is a perspective diagram of a toner container viewed from a right side.

As shown in FIG. 4 and FIG. 5, on an inner side surface 43A (left side surface) of the support plate 43, a plurality of groove-like container guides 45, extending diagonally upward, are formed. The container guides 45 are each formed in the shape of a groove by recessing the inner side surface 43A of the support plate 43 in the thickness direction. In addition, each container guide 45 is formed such that an end portion thereof on the upper side of the support plate 43 is formed to spread upward. The right end portion of the housing 51 is supported by a lower end portion of the container guide 45 by being guided by the container guide 45 diagonally downward from the upper end of the support plate 43.

In the storage space provided in the housing 51, a stirring paddle (not shown) and a screw portion 58 (not shown) are provided, wherein the stirring paddle is configured to stir the toner, and the screw portion is configured to convey the toner to the toner discharge port 52. These portions extend in the longitudinal direction of the housing 51.

As shown in FIG. 8, the side cover 72 is provided on a right end portion of the housing 51. In other words, the side cover 72 constitutes the right end portion of the housing 51. The side cover 72 is provided to cover a side wall 51B of the housing 51 that is on the right side thereof. The side wall 51B has a toner filling port 59 through which the toner is filled into the housing 51. The toner filling port 59 is closed by a plug member 60.

As shown in FIG. 7 and FIG. 8, the toner discharge port 52 is formed in the toner container 50. The toner discharge port 52 is formed in a right end portion of the bottom of the housing 51. Specifically, a cylindrical portion 51A is formed on the side wall 51B of the housing 51 on the right side. The cylindrical portion 51A is formed at a lower portion of the side wall 51B. The cylindrical portion 51A is in an approximate shape of a cylinder protruding from the side wall 51B outward (rightward). An inner space of the cylindrical portion 51A is communicated with an inner space of the housing 51, namely, a portion storing the toner. The cylindrical portion 51A is integrally formed with the housing 51. The toner discharge port 52 is provided in a circumferential surface of the cylindrical portion 51A. Specifically, the toner discharge port 52 is provided in a lower portion of the circumferential surface of the cylindrical portion 51A. The toner discharge port 52 is formed to pierce through a circumferential wall that constitutes the circumferential surface of the cylindrical portion 51A, downward.

The opening/closing mechanism 53 is configured to open and close the toner discharge port 52. The opening/closing mechanism 53 is provided on the cylindrical portion 51A. The opening/closing mechanism 53 includes a cylindrical shutter member 61 (see FIG. 7) and a second coupling portion 79, wherein the shutter member 61 is disposed inside the cylindrical portion 51A, and the second coupling portion 79 is formed in a shape of a hook and disposed outside the cylindrical portion 51A. The shutter member 61 is an example of the opening/closing member of the present disclosure. It is noted that FIG. 7 shows a state where the toner discharge port 52 is closed by the shutter member 61. In the cylindrical portion 51A, the shutter member 61 can pivot between a closing position to close the toner discharge port 52 and an opening position to open the toner discharge port 52. When a rotational driving force is applied to the second coupling portion 79 from outside and the shutter member 61 pivots from the closing position to the opening position, the toner discharge port 52 is opened. On the other hand, when a rotational driving force of an opposite direction is applied to the second coupling portion 79 from outside and the shutter member 61 pivots from the opening position to the closing position, the toner discharge port 52 is closed. That is, the toner discharge port 52 is opened or closed when the shutter member 61 pivots upon receipt of a rotational driving force.

When the toner container 50 is attached to the attachment portion 40, the second coupling portion 79 is coupled with a drive transmission mechanism (not shown) that is provided in the attachment portion 40 of the apparatus main body 28. This allows the second coupling portion 79 to receive a rotational force from the drive transmission mechanism. The drive transmission mechanism is provided on a side surface of the support plate 43 opposite to the inner side surface 43A. The drive transmission mechanism transmits, from a first coupling portion 78 described below to the second coupling portion 79, an operational driving force (rotational driving force) that was input to the first coupling portion 78 with an operation of the operation portion 54. The drive transmission mechanism is, for example, a gear transmission mechanism that includes two gears 74 and 75 (see FIG. 4 and FIG. 5) that mesh with each other.

When the toner container 50 is attached to the attachment portion 40, the toner discharge port 52 is disposed to face a communication port (not shown) that is formed in the intermediate transfer unit 22, and comes into close contact with the communication port. The toner is supplied from the communication port to the developing device 12 via a conveyance path (not shown). An attachment position of the toner container 50 in the attachment portion 40 is determined so that the above-described positional relationship is satisfied.

As shown in FIG. 8, the operation portion 54 is provided in the right end portion of the housing 51. The operation portion 54 is used to open and close the toner discharge port 52 in a state where the toner container 50 is attached to the attachment position on the attachment portion 40. Specifically, the operation portion 54 is used to pivot the shutter member 61 between the opening position and the closing position. It is noted that FIG. 8 shows a state where the toner discharge port 52 is opened by the shutter member 61. The operation portion 54 includes a shaft portion 66 and a lever 67 (an example of the operation member). That is, the lever 67 is provided in the right end portion of the housing 51. The shaft portion 66 is rotatably supported by the side wall 51B of the housing 51. The lever 67 is a bar-like member that is fixed to the shaft portion 66 and extends from the shaft portion 66.

Figure 9A:
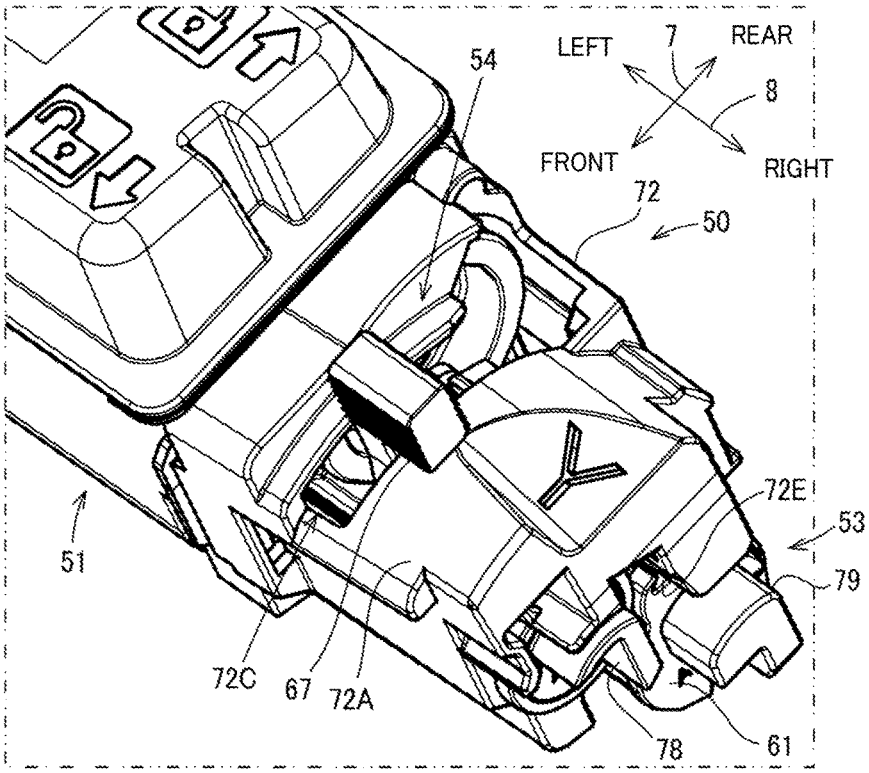
FIG. 9A is a diagram showing a state before a lever of an operation portion is pivoted.
Figure 9B:
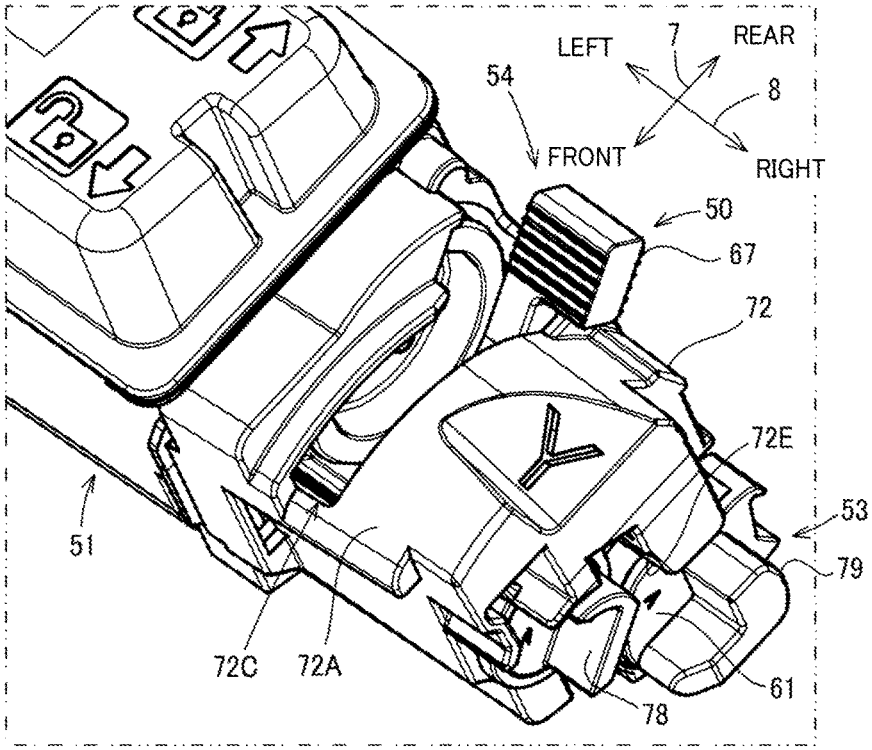
FIG. 9B is a diagram showing a state after the lever of the operation portion is pivoted.

The shaft portion 66 includes a shaft core that extends rightward from the right end of the housing 51. The lever 67 is configured to integrally pivot with the shaft portion 66 around the shaft core of the shaft portion 66. In the present embodiment, the operation portion 54 can pivot between a first operation position (the attitude shown in FIG. 9A) where the lever 67 is inclined frontward, and a second operation position (the attitude shown in FIG. 9B) where the lever 67 is inclined rearward. In the present embodiment, with the operation of the lever 67 between the first operation position and the second operation position, the shutter member 61 of the opening/closing mechanism 53 is moved to the closing position corresponding to the first operation position, or to the opening position corresponding to the second operation position. Here, the first operation position is a position corresponding to the closing position of the shutter member 61. Specifically, when the shutter member 61 is maintained at the closing position or displaced to the closing position, the lever 67 is disposed at the first operation position. On the other hand, the second operation position is a position corresponding to the opening position of the shutter member 61. Specifically, when the shutter member 61 is maintained at the opening position or displaced to the opening position, the lever 67 is disposed at the second operation position.

Meanwhile, according to a conventional technique, when toner in a toner container 50 is consumed and the toner container 50 becomes empty, a light-emitting member provided in the vicinity of the attachment portion 40 to which the toner container 50 is attached, is lit to notify the user of the toner container 50 that needs to be replaced. However, even when the light-emitting member provided near the attachment portion 40 is lit, if the toner container 50 itself is not lit, the user cannot recognize the replacement target easily. On the other hand, if the light-emitting member is provided on the toner container 50, and the light-emitting member is lit at a replacement timing by receiving power supply, the user will be able to recognize the replacement target easily. However, if the removed toner container 50 is not reused, the light-emitting member is discarded with the toner container 50. Thus, providing the light-emitting member on the toner container 50 is not preferable in view of the cost. In addition, it is necessary to provide a power supply path that extends to the light-emitting member of the toner container 50. This makes the configuration of the toner container 50 complicate. As described below, the toner container 50 and the image forming apparatus 10 of the present embodiment are configured such that the user can easily recognize a replacement-target toner container 50 in a state where the toner container 50 is attached to the image forming apparatus 10.

In the present embodiment, the lever 67 is formed from a light-transmitting member configured to guide light inward and emit the light outward. As the light-transmitting member, a transparent or translucent resin member is applicable. With this configuration, when light emitted from a light emitter 121 described below is irradiated on the lever 67, the lever 67 guides the light inward so that the light is irregularly reflected therein, and a part or the whole light is deflected upward. It is noted that in this case, the lever 67 is an example of the deflection portion of the present disclosure.

It is noted that the lever 67 is not limited to the one formed from a light-transmitting member. For example, the lever 67 may include a reflection surface that reflects light emitted from the light emitter 121 described below, upward. In this case, the reflection surface corresponds to the deflection portion of the present disclosure. Of course, the lever 67 may have any configuration as far as it can deflect light emitted from the light emitter 121 upward.

In addition, a lock member 71 is provided at the right end of the housing 51. The lock member 71 locks the operation portion 54 and the opening/closing mechanism 53 to prevent them from malfunctioning. That is, the lock member 71 locks the operation portion 54 so as to restrict the operation of the operation portion 54. Furthermore, the lock member 71 locks the opening/closing mechanism 53 so as to restrict the opening/closing operation of the opening/closing mechanism 53. The lock member 71 is integrally formed with a releasing portion 71A that is claw-like and projecting rightward. It is noted that since the lock member 71 is not a major component of the present disclosure, detailed description of the lock member 71 is omitted.

As shown in FIG. 7 and FIG. 8, the side cover 72 is attached to the side wall 51B at the right end of the housing 51. The side cover 72 is attached in such a way as to cover the base part of the lever 67, the lock member 71 and the like. An arc-shaped slit 72C is formed in an upper surface 72A of the side cover 72. The slit 72C is a through groove that extends and is elongated in the front-rear direction 7 in the upper surface 72A. An upper end of the lever 67 is exposed upward out of the slit 72C. Accordingly, when operated, the lever 67 moves between the first operation position and the second operation position along the slit 72C while guided by the slit 72C.

Figure 10A:
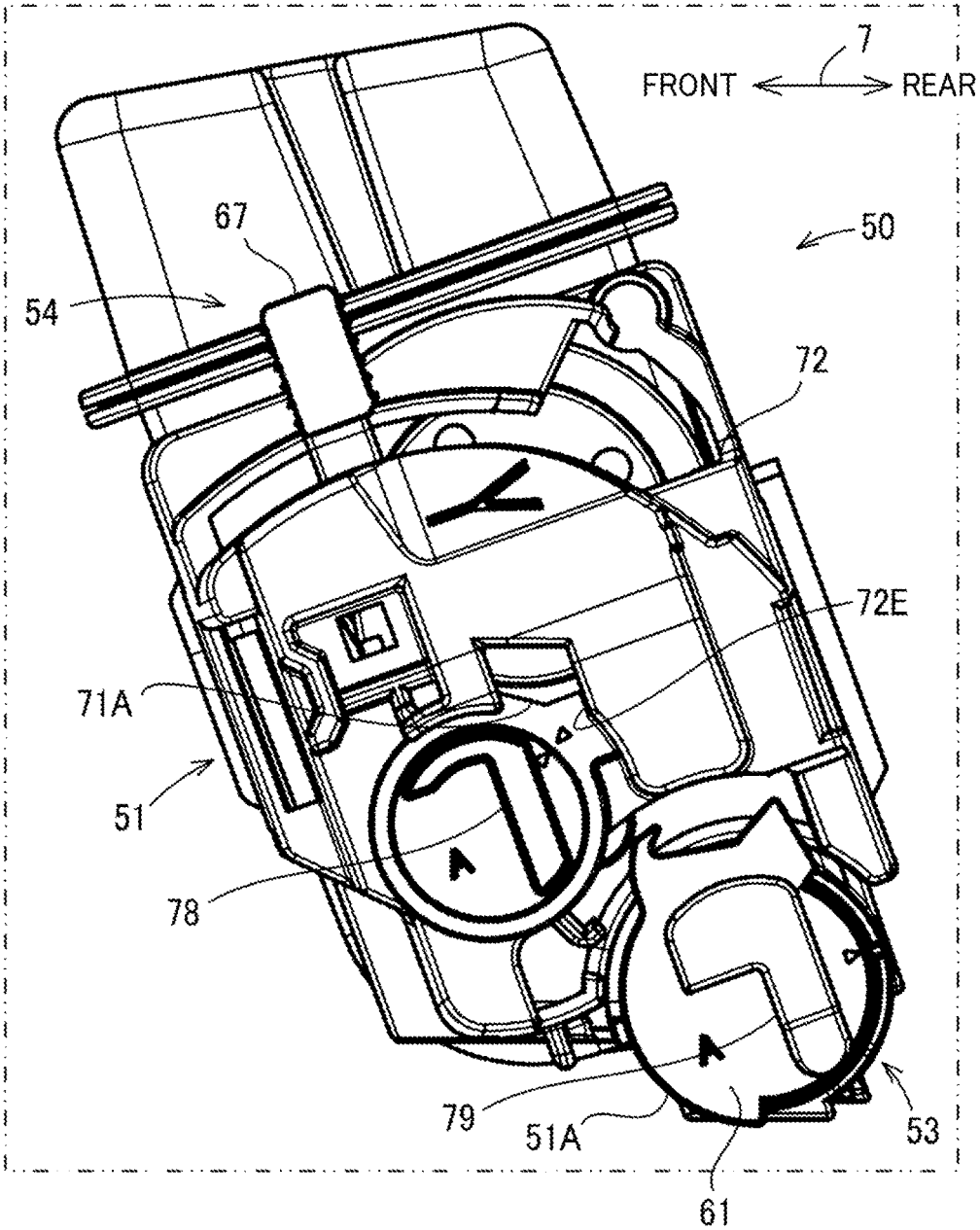
FIG. 10A and FIG. 10B are diagrams showing positions of a first coupling portion and a second coupling portion corresponding to operation positions of the lever of the operation portion.
Figure 10B:
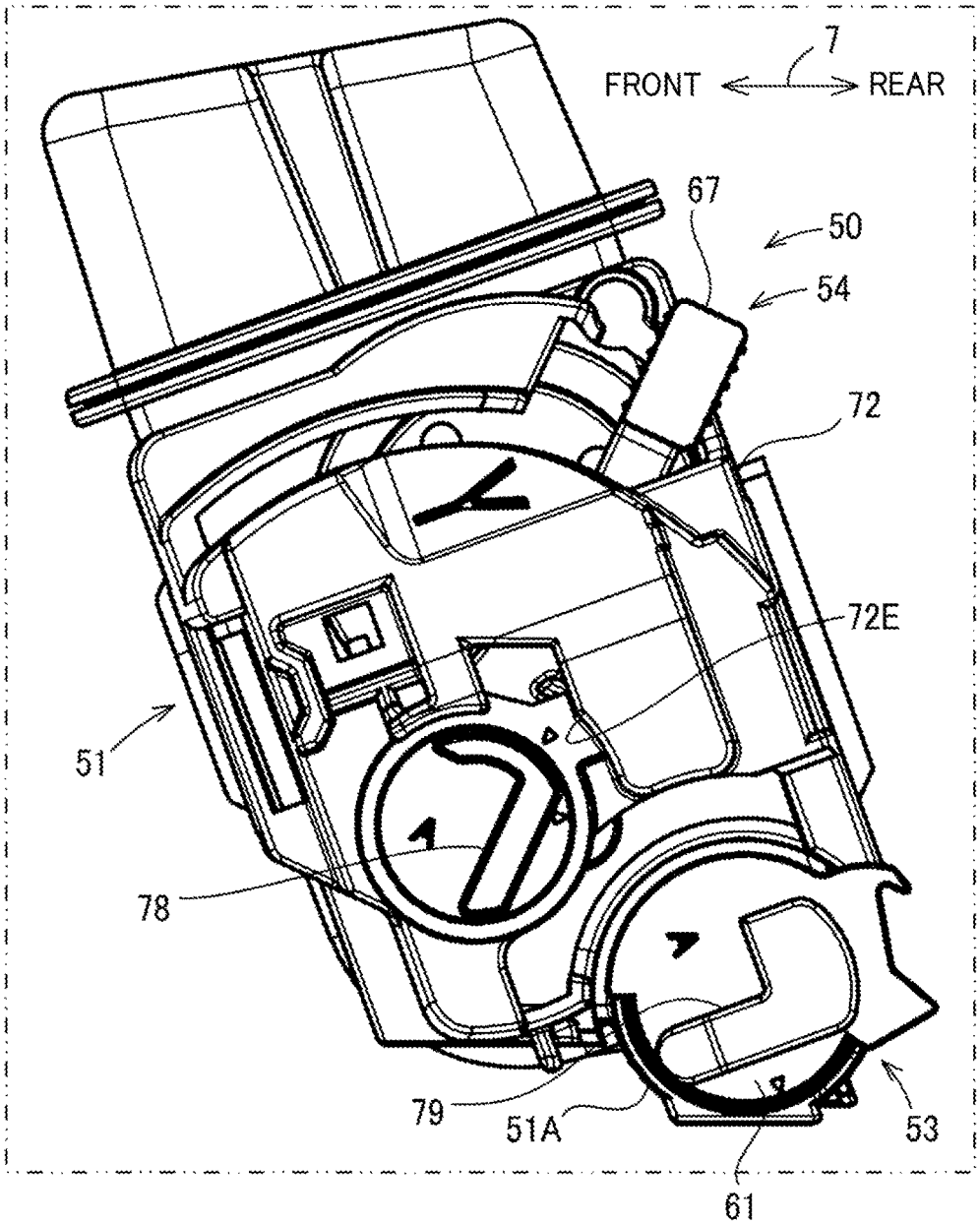

As shown in FIG. 8, an opening 72D is formed in a right side surface 72B of the side cover 72. A first coupling portion 78 described below is exposed rightward out of the opening 72D. In addition, a guide groove 72E is formed on the right side surface 72B, wherein the guide groove 72E extends vertically and is opened downward. As shown in FIG. 10A, a release portion 71A of the lock member 71 is exposed out of the side cover 72 at the guide groove 72E. It is noted that the second coupling portion 79 of the shutter member 61 is not covered with the side cover 72.

As shown in FIG. 8, the side cover 72 includes a block-like positioning projection portion 73 projecting rightward from the right end of the housing 51. The positioning projection portion 73 is formed with a width that is slightly smaller than the groove width of the container guide 45 such that the positioning projection portion 73 can be fitted in the container guide 45 (see FIG. 4). This enables the positioning projection portion 73 to be attached to the container guide 45. Specifically, as shown in FIG. 4, when the positioning projection portion 73 is fitted in the container guide 45 and guided by the container guide 45 diagonally downward, the housing 51 is attached to the support plate 43.

As shown in FIG. 9A to FIG. 10B, the operation portion 54 of the toner container 50 includes a claw-like first coupling portion 78. The first coupling portion 78 is rotated with the operation of the lever 67 of the operation portion 54. The first coupling portion 78 is integrally formed with the right end of the shaft portion 66. The first coupling portion 78 is formed in the shape of a plate rib that projects rightward from the right end of the shaft portion 66. The first coupling portion 78 extends in the attachment direction (namely, diagonally downward) in which the side cover 72 is guided by the container guide 45 when the housing 51 is attached to the support plate 43. The first coupling portion 78 is rotatably coupled with the drive transmission mechanism (not shown) when the toner container 50 is attached to the container guide 45 of the support plate 43. That is, the first coupling portion 78 is coupled with the drive transmission mechanism in the state where the toner container 50 is attached. With this configuration, the operation driving force that is input with the operation of the lever 67 is transmitted to the drive transmission mechanism. As described above, the second coupling portion 79 of the opening/closing mechanism 53 is rotatably coupled with the drive transmission mechanism when the toner container 50 is attached to the container guides 45 of the support plate 43. As a result, when the operational driving force is applied to the lever 67 in the state where the toner container 50 is disposed at the attachment position, the operational driving force is transmitted to the shutter member 61 via the first coupling portion 78, the drive transmission mechanism, and the second coupling portion 79, and the shutter member 61 is displaced to the opening position or the closing position.

Figure 15:
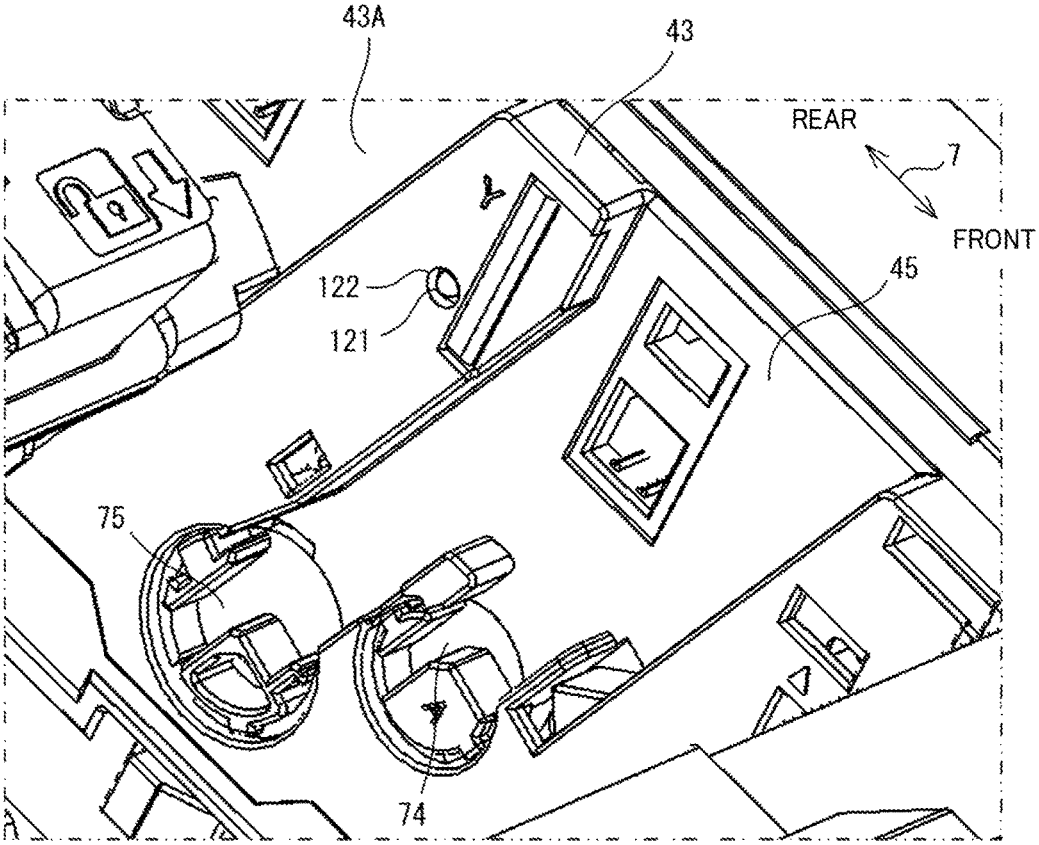
FIG. 15 is a diagram partially showing a configuration of a support plate at a right side of the attachment portion.

As shown in FIG. 15, the light emitter 121 (an example of the light-emitting member) is provided in the inner side surface 43A of the support plate 43. The light emitter 121 emits light toward the toner container 50 in the state where the toner container 50 is attached to the attachment portion 40. The light emitter 121 is, for example, an LED element. In the inner side surface 43A, four light emitters 121 are provided in the vicinities of the four container guides 45 on one-to-one basis. Specifically, emission windows 122 that pierce the support plate 43 are formed in the inner side surface 43A, and each of the light emitters 121 is attached to the support plate 43 such that light can be emitted from the corresponding emission window 122 toward the right end portion of the toner container 50.

The lighting of the light emitters 121 is controlled by a control portion of the image forming apparatus 10. In the present embodiment, the control portion lights the light emitter 121 when a predetermined condition is satisfied. For example, when the toner in the toner container 50 is consumed and the toner container 50 becomes empty, the control portion lights the light emitter 121. The control portion determines whether or not the toner container 50 has become empty based on an output signal from a weight sensor or a magnetic sensor that detects the toner amount in the toner container 50. This enables the user to find the empty toner container 50 with a light emitter 121 emitting light as a mark when the user replaces the toner container 50. In other words, the image forming apparatus 10 notifies the user of a toner container 50 that is to be replaced, by lighting a light emitter 121 that is in the vicinity of the attachment position of the toner container 50 in the attachment portion 40.

However, even when the light emitter 121 provided in the attachment portion 40 is lit, if the toner container 50 itself is not lit, the user cannot recognize the replacement-target toner container 50 easily. On the other hand, if a light-emitting member such as an LED element is provided on the toner container 50, and the light-emitting member is lit as necessary, the user will be able to recognize the replacement target toner container 50 easily. However, if the light-emitting member is provided on the toner container 50, the light-emitting member is discarded with the removed toner container 50. Thus, providing the light-emitting member on the toner container 50 is not preferable in view of the cost. In addition, it is necessary to provide a power supply path that extends to the light-emitting member of the toner container 50. This makes the configuration of the toner container 50 complicate.

Figure 16:
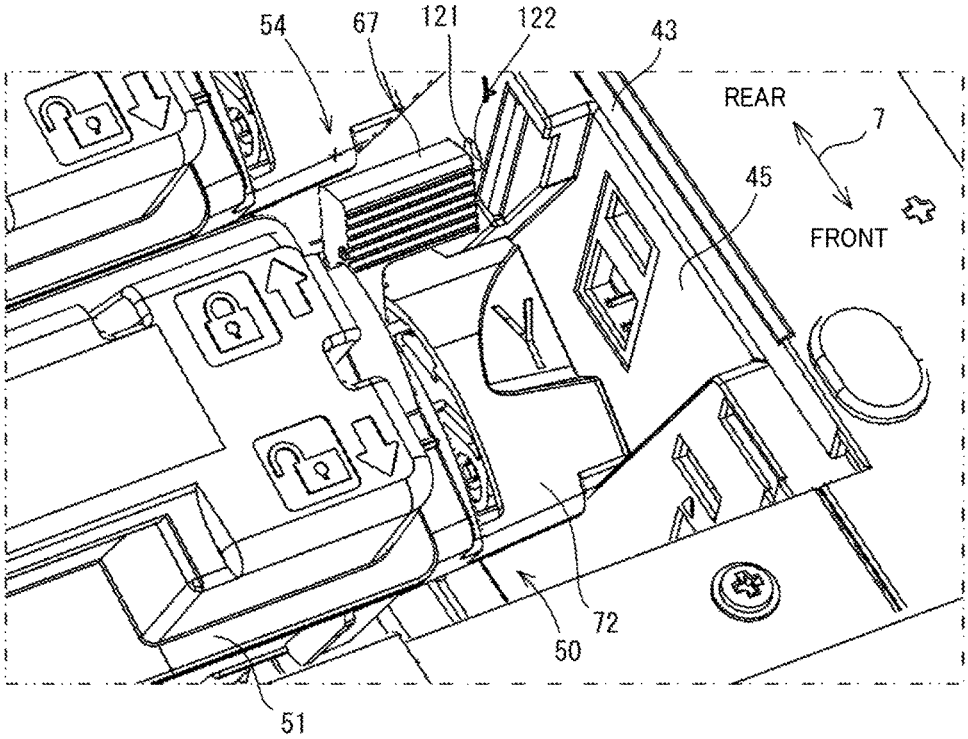
FIG. 16 is a perspective diagram showing a state where a side cover of a toner container is attached to a toner guide of the support plate.

In the present embodiment, when the lever 67 is disposed at the second operation position, the lever 67 receives the light emitted from the light emitter 121. As shown in FIG. 16, when the lever 67 is disposed at the second operation position, the lever 67 faces the emission window 122 in the inner side surface 43A. When the lever 67 is disposed at such a position (second operation position), the lever 67 receives the light emitted from the light emitter 121. The light received by the lever 67 is guided into the lever 67, is irregularly reflected therein, and a part or all of the light is deflected upward. With this configuration, the deflected light travels upward, and when the user opens the top cover 28B to replace the toner container 50, the lever 67 of the toner container 50 that is to be replaced looks like shining. This makes it possible for the user to recognize the replacement-target toner container 50 easily.

Figure 11:
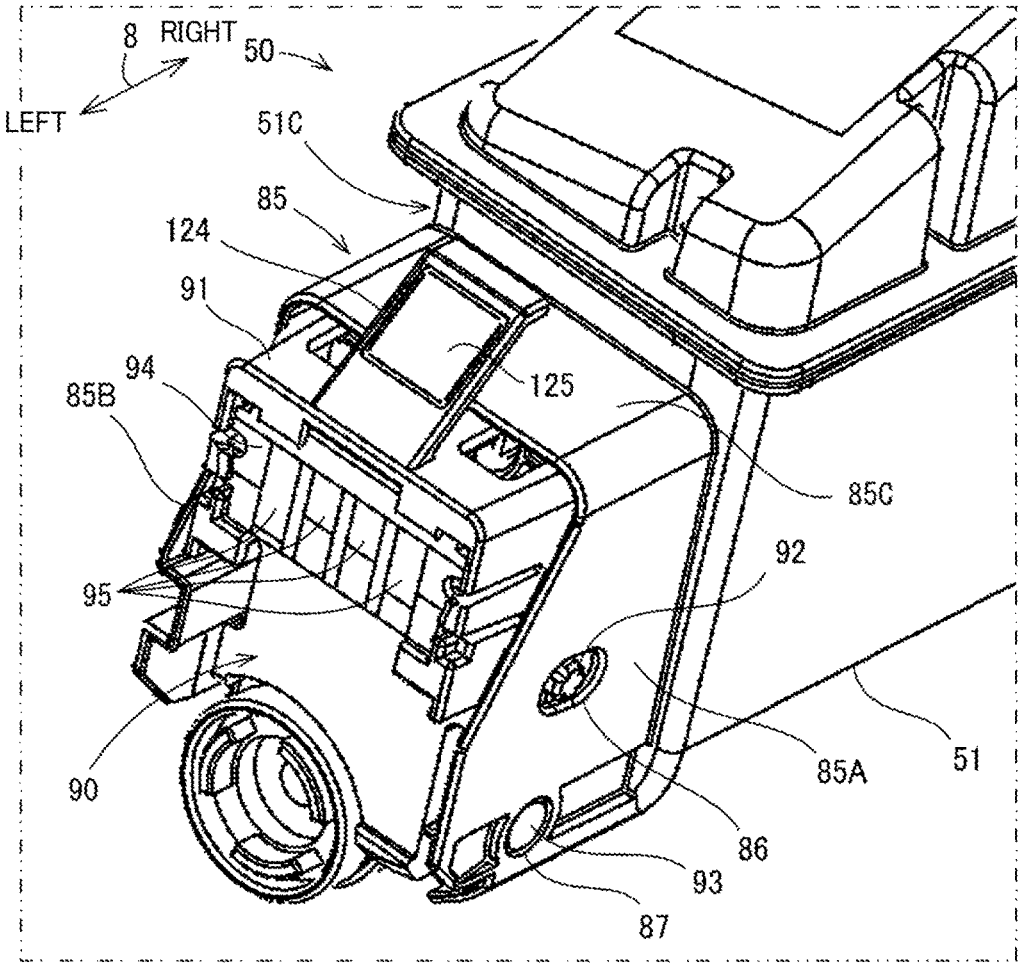
FIG. 11 is a perspective diagram of the toner container viewed from a left side.

As shown in FIG. 4 and FIG. 11, the toner container 50 includes a protruding portion 85 (an example of the support portion) and a holder 90 (an example of the displacement member).

As shown in FIG. 11, the protruding portion 85 and the holder 90 are provided on a side wall 51C at one of opposite ends of the housing 51 in the longitudinal direction. Specifically, the protruding portion 85 is integrally formed with the side wall 51C, and the holder 90 is supported by the protruding portion 85.

The protruding portion 85 is supported by the attachment portion 40. The protruding portion 85 is formed by bending a plate in a rectangular shape so as to extend outward from the side wall 51C in the longitudinal direction. The protruding portion 85 includes side walls 85A and 85B at opposite ends of the container main body in the short direction. The protruding portion 85 further includes a top wall 85C that connects upper ends of the side walls 85A and 85B. The side walls 85A and 85B are parallel to each other, and their outer side surfaces are formed to be flat.

When the toner container 50 is attached to the attachment portion 40, the protruding portion 85 is inserted in a guide groove 100 (see FIG. 13) formed on the support plate 42 of the attachment portion 40, and guides the toner container 50 in the attachment/detachment direction of the toner container 50. At this time, the side walls 85A and 85B of the protruding portion 85 abut on the guide groove 100, and are guided in the guide direction of the guide groove 100 (the same direction as the attachment/detachment direction of the toner container 50). Subsequently, the protruding portion 85 is guided diagonally downward from the upper end of the support plate 42 by the guide groove 100, and is supported at a lower-end portion of the guide groove 100.

As shown in FIG. 11, long holes 86 that are elongated in the longitudinal direction are formed at approximate centers of the side walls 85A and 85B. In FIG. 11, the long hole 86 on the side wall 85B side is not shown since it is hidden by another member. The long holes 86 play a role of guiding guide shafts 92 of the holder 90 in the longitudinal direction so as to move the holder 90 in the direction of approaching and separating from the side wall 51C of the housing 51, and a role of restricting the range of the movement. In addition, shaft holes 87 are formed at lower end portions of the side walls 85A and 85B below the long holes 86, wherein the shaft holes 87 function as a fulcrum around which the holder 90 pivots. Pivot shafts 93 of the holder 90 are inserted in the shaft holes 87, and the shaft holes 87 pivotally support the pivot shafts 93.

As shown in FIG. 11, the holder 90 is supported by the protruding portion 85. Specifically, the holder 90 is attached inside the protruding portion 85 surrounded by the top wall 85C and the side walls 85A and 85B. The holder 90 includes a holder main body 91, the guide shafts 92, and the pivot shafts 93. The holder main body 91 is partially stored in the protruding portion 85. The guide shafts 92 are inserted in the long holes of the protruding portion 85. The pivot shafts 93 are pivotably supported by the shaft holes 87 of the protruding portion 85. The holder 90 is a synthetic resin product formed from synthetic resin by the injection molding. Accordingly, the holder main body 91, the guide shafts 92, and the pivot shafts 93 are integrally formed.

The holder main body 91 is formed in a rectangular parallelepiped shape that is hollow inside. Four connection terminals 95 (an example of the first contact portion) are formed on a surface 91A (holding surface) of the holder main body 91. The surface 91A faces a side wall 100B (see FIG. 13) of a fixing portion 47 that is described below. The connection terminals 95 are configured to connect to a storage portion (not shown) such as a chip memory or a flash memory. The four connection terminals 95 are provided on a substrate 94 exposed on the surface 91A of the holder main body 91. Each of the four connection terminals 95 is electrically conducted with a conductive material when contacted therewith. The four connection terminals 95 are disposed in alignment in the width direction on the substrate 94.

The storage portion stores information regarding the toner stored in the toner container 50. The information regarding the toner includes, for example, an amount of toner stored in an unused toner container 50, a remaining amount of toner, a time when the toner was stored, and a condition to which the toner is applicable. It is noted that the storage portion is fixed to a rear side of the holder main body 91 or the side wall 51C, and is connected to the connection terminals 95 by a wire harness that includes a signal line and a power line.

The guide shafts 92 are provided at the center portions of opposite sides of the holder main body 91 in the width direction. The guide shafts 92 are cross-shaped in cross section, and project from the sides of the holder main body 91 outward. The guide shafts 92 are inserted in the long holes 86 of the protruding portion 85. It is noted that the projection length of the guide shafts 92 is determined such that the guide shafts 92 inserted in the long holes 86 do not project outward from the outer side surfaces of the side walls 85A and 85B of the protruding portion 85.

The pivot shafts 93 are provided in lower end portions of the opposite sides of the holder main body 91 in the width direction. The pivot shafts 93 are circular in cross section, and project from the sides of the holder main body 91 outward. The pivot shafts 93 are inserted in the shaft holes 87 of the protruding portion 85. This allows the holder 90 to pivot around the lower end portion (lower portion) of the protruding portion 85 as the pivotal fulcrum. It is noted that the projection length of the pivot shafts 93 is determined such that the pivot shafts 93 inserted in the shaft holes 87 do not project outward from the outer side surfaces of the side walls 85A and 85B of the protruding portion 85.

Figure 12A:
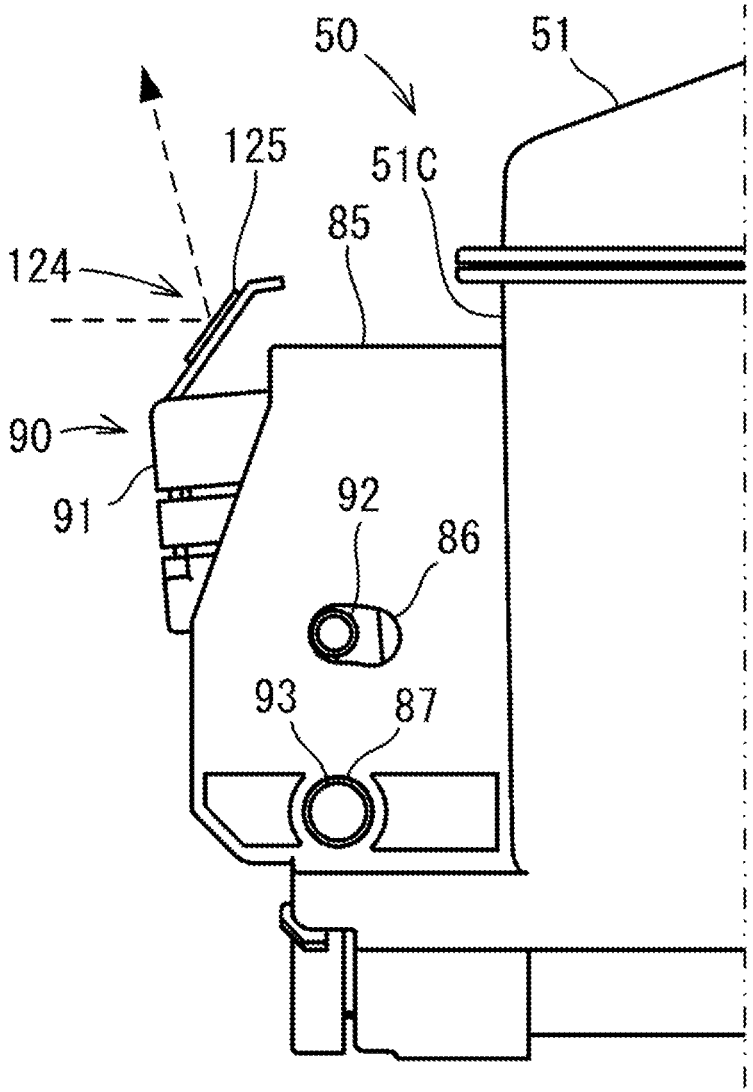
FIG. 12A and FIG. 12B are diagrams showing pivot positions of a holder and light reflection directions.

With the above-described configuration of the holder 90, the holder 90 is attached to the protruding portion 85 by allowing the pivot shafts 93 to be supported by the shaft holes 87, and inserting the guide shafts 92 in the long holes 86. In addition, the holder 90 is supported by the protruding portion 85 so as to pivot around the pivot shafts 93 as the pivotal center. This enables the holder 90 to be displaced in the direction of approaching and separating from the protruding portion 85 along the longitudinal direction of the toner container 50. More specifically, the holder 90 is configured to pivot around the lower portion of the protruding portion 85 with the pivot shafts 93, between a separate position (the position shown in FIG. 12A) and an adjacent position (the position shown in FIG. 12B), wherein at the separate position, the holder 90 is outside and most separate from the protruding portion 85, and at the adjacent position, the holder main body 91 is partially embedded in the protruding portion 85 and the holder 90 is closest to the side wall 51C. When the holder 90 is at the separate position, the holder main body 91 is drawn out from the protruding portion 85 at the maximum and is most separate from the side wall 51C.

It is noted that an elastic member (not shown) such as a compression spring is provided on the rear side of the holder 90. The elastic member at all times presses an upper end portion of the holder 90 that is located (on an upper side) opposite to the pivot shafts 93 of the holder 90, outward (leftward in FIG. 12), namely, toward the separate position. By an elastic biasing force of the elastic member, the holder 90 is biased in a direction to be separate from the protruding portion 85. As a result, in a state where no external force is applied to the holder 90, the holder 90 is always at the separate position. On the other hand, when the toner container 50 is attached to the attachment portion 40, and the protruding portion 85 is supported by the lower portion of the guide groove 100, the holder 90 receives a pressing force from the side wall 100B of the fixing portion 47 due to elastic deformation of connection terminals 103 that are described below. The pressing force presses the holder 90 toward the protruding portion 85 and compresses the elastic member, and the holder 90 pivots from the separate position to the adjacent position.

As shown in FIG. 3A and FIG. 3B, the support plate 42 is erected on the left end portion of the attachment portion 40. The support plate 42 is configured to support the protruding portion 85 and the holder 90 that are provided at one end of each of the four toner containers 50. The support plate 42 extends in the front-rear direction 7 and faces the protruding portions 85 of the four toner containers 50. The support plate 42 supports an end portion of each of the toner containers 50 on the side wall 51C side, specifically, supports the protruding portion 85 and the holder 90. Each protruding portion 85 is supported by a corresponding fixing portion 47 provided on the support plate 42.

Figure 13:
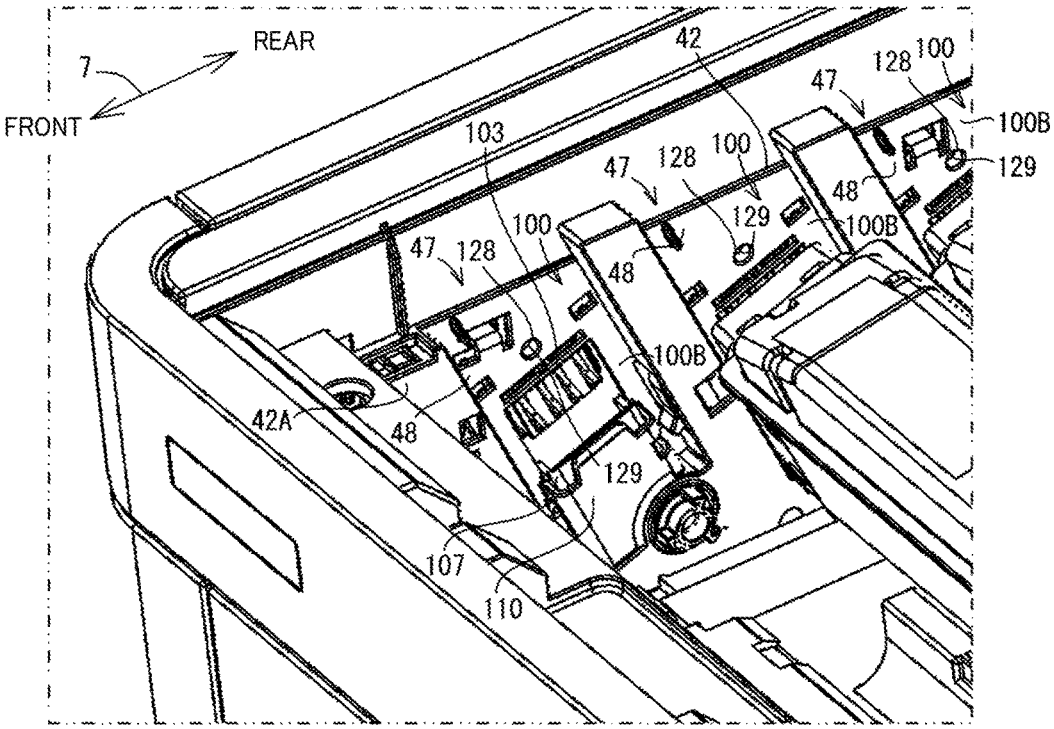
FIG. 13 is a diagram partially showing a configuration of a support plate at a left side of the attachment portion.
Figure 14A:
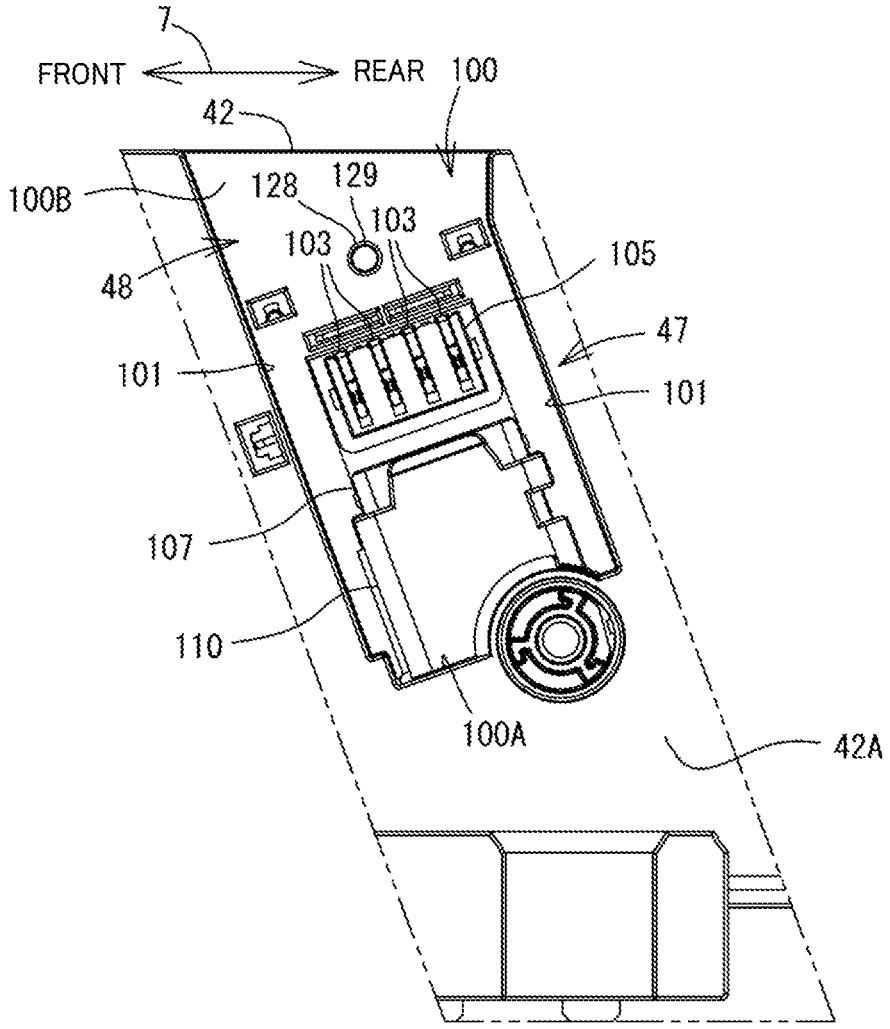
FIG. 14A and FIG. 14B are diagrams showing a fixing portion at which a holder is fixed.
Figure 14B:
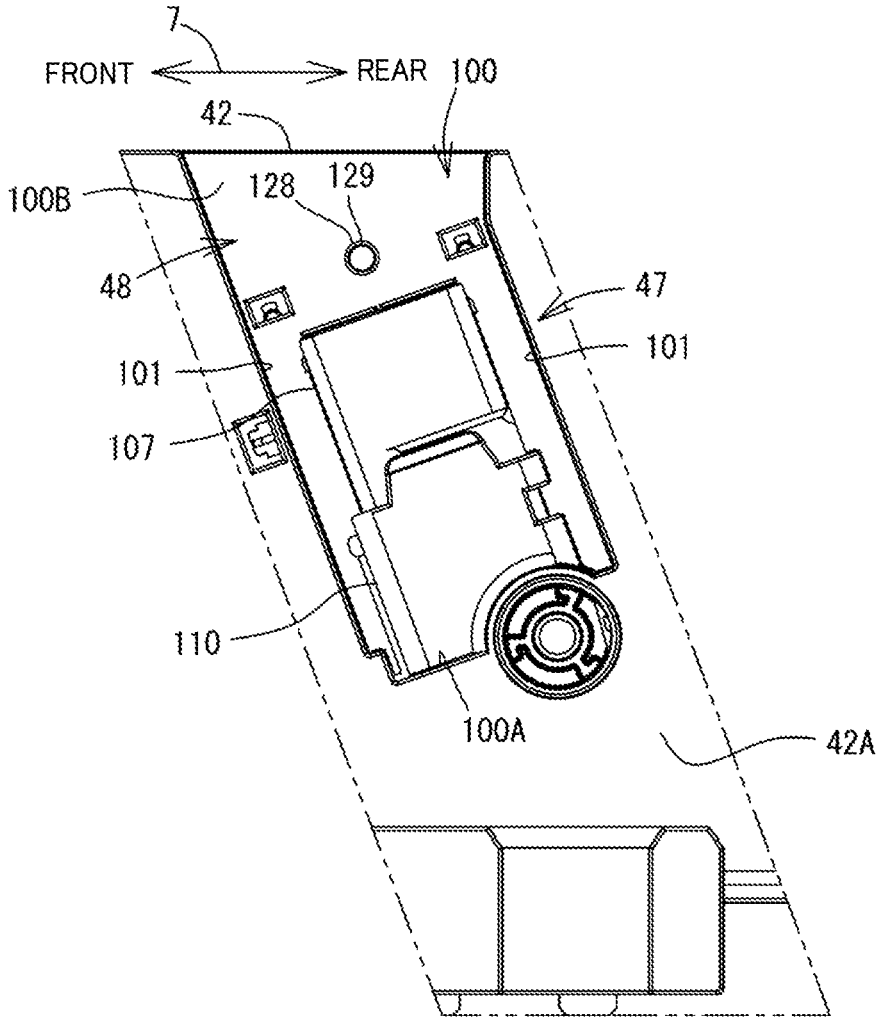

As shown in FIG. 13, FIG. 14A, and FIG. 14B, each of the fixing portions 47 includes the guide groove 100. The guide groove 100 includes a pair of guide surfaces 101 at opposite ends thereof in the front-rear direction 7. The guide surfaces 101 of the guide groove 100 extend diagonally upward from a lower end 100A of the guide groove 100, and are flat and parallel to each other. A portion located between the guide surfaces 101 is a recessed portion 48 that is formed by recessing, in the thickness direction, an inner side surface 42A (right side surface) of the support plate 42, and inner surfaces on the front side and the rear side of the recessed portion 48 are the guide surfaces 101. In other words, when the recessed portion 48 whose upper side is open is formed on the inner side surface 42A of the support plate 42, the guide groove 100 is formed on the inner side surface 42A.

As shown in FIG. 14A, the fixing portion 47 includes four connection terminals 103 (an example of the second contact portion). The four connection terminals 103 are provided on a side wall 100B of the guide groove 100 that is parallel to the support plate 42. The side wall 100B is a facing surface that faces the holder 90 in a state where the toner container 50 is disposed at the attachment position of the attachment portion 40. The four connection terminals 103 are configured to contact and be electrically conducted with the four connection terminals 95 of the toner container 50. The four connection terminals 103 respectively correspond to the four connection terminals 95, and are disposed at positions that face the connection terminals 95 in the state where the toner container 50 is attached to the attachment portion 40. The connection terminals 103 are each formed by bending and deforming a metal-made conductive wire member or a metal-made narrow, elongated plate member. One end of each of the connection terminals 103 is fixed to a substrate 105 that is attached to the side wall 100B. In addition, the other end of each of the connection terminals 103 includes a contact portion (not shown) having a curved shape projecting in a direction vertical to the surface of the side wall 100B (in a direction directed to the front of the plane of FIG. 14A). The contact portion is the top of each connection terminal 103 in the direction vertical to the surface of the side wall 100B. With this configuration, the connection terminals 103 has spring property and can be elastically deformed in the direction vertical to the surface of the side wall 100B. That is, the connection terminals 103 are formed in such a way as to be elastically deformed upon receiving a pressing force directed toward the side wall 100B. The contact portions of the connection terminals 103 contact the connection terminals 95. It is noted that the wire harness is connected to the substrate 105, and end portions of the connection terminals 103 on the fixed side are electrically connected to the wire harness.

During the process of attaching the toner container 50 to the attachment portion 40, the connection terminals 95 of the holder 90 contact the connection terminals 103. Subsequently, when the toner container 50 is further pushed to the attachment position in the attachment portion 40, the connection terminals 95 and the connection terminals 103 come into stronger contact with each other. At this time, the connection terminals 103 are bent toward the substrate 105, and an elastic pressing force (elastic biasing force) due to the spring property of the connection terminals 103 is applied to the holder 90 via the connection terminals 95. In the present embodiment, the holder 90 is at the separate position before the toner container 50 is attached to the attachment portion 40, and after the toner container 50 is attached to the attachment portion 40, the holder 90 receives the pressing force by the contact of the connection terminals 95 and the connection terminals 103 and is displaced to the adjacent position. The holder 90 receives the pressing force from the connection terminals 103 at the attachment position, thereby is disposed at the adjacent position in a reliable manner. It is noted that there may be a case where the connection terminals 95 or the connection terminals 103 are damaged or defected and the connection terminals 95 and the connection terminals 103 do not contact each other. In this case, since the connection terminals 95 do not contact the connection terminals 103, the holder 90 does not receive the pressing force, and is displaced at the separate position although the toner container 50 is attached to the attachment portion 40.

On the side wall 100B of the guide groove 100, a cover 107 for covering the four connection terminals 103 is provided. The cover 107 is slidably supported by the side wall 100B. The cover 107 is configured to move between a coverage position (the position shown in FIG. 14B) and an exposure position (the position shown in FIG. 14A), wherein at the coverage position, the cover 107 covers the connection terminals 103, and when the cover 107 is at the exposure position, the connection terminals 103 are exposed. As a slide support mechanism of the cover 107, a known rail support mechanism including rails and rail guides is applicable. During an attachment operation of attaching the toner container 50 to the attachment portion 40, the cover 107 receives a force from the toner container 50, and moves to the exposure position to expose the connection terminals 103. In addition, the cover 107 is moved to the coverage position when the toner container 50 is not attached. This allows the cover 107 to protect the connection terminals 103.

The guide groove 100 has a storage portion 110 configured to store the cover 107 when the cover 107 is at the exposure position. The storage portion 110 is fixed to the side wall 100B. The storage portion 110 is disposed at a position that is farther away from the side wall 100B than the cover 107. When the cover 107 moves to the exposure position, the cover 107 is stored in a storage space formed between the side wall 100B and the storage portion 110. A stopper (not shown) that restricts the movement of the cover 107 is formed in the storage portion 110. When the cover 107 is pulled down to the exposure position, the lower end of the cover 107 abuts on the stopper, and the cover 107 is restricted from going beyond the position downward.

As shown in FIG. 11, the holder 90 includes a reflection portion 124 (an example of the deflection portion). The reflection portion 124 has a reflection surface 125 that reflects light upward. The reflection portion 124 is provided on an upper surface (upper portion) of the holder main body 91. Since the reflection portion 124 is provided on the upper surface of the holder main body 91, if the holder 90 is displaced in the direction of approaching and separating, the reflection portion 124 is displaced in the same direction as the holder 90.

As shown in FIG. 13, the inner side surface 42A of the support plate 42 has a plurality of light emitters 128 (an example of the light emitting member). Each of the light emitters 128 emits light to the reflection portion 124 of the corresponding toner container 50 in a state where the toner container 50 is attached to the attachment portion 40. The light emitters 128 are, for example, LED elements. In the inner side surface 42A, four light emitters 128 are respectively provided on the four fixing portions 47. Specifically, emission windows 129 that pierce the support plate 42 are formed in an upper portion of the side wall 100B of the guide groove 100, and each of the light emitters 128 is attached to the support plate 42 such that light can be emitted from the corresponding emission window 129 toward the left end portion of the toner container 50.

As is the case with the light emitters 121, the lighting of the light emitters 128 is controlled by the control portion of the image forming apparatus 10. In the present embodiment, the control portion lights the light emitter 128 when a predetermined condition is satisfied. For example, when toner in a toner container 50 is consumed and the toner container 50 becomes empty, the control portion lights the corresponding light emitter 128. This enables the user to find the empty toner container 50 with the lighting light emitter 128 as a mark when the user replaces the toner container 50. In other words, the image forming apparatus 10 notifies the user of a toner container 50 that is to be replaced, by lighting the light emitter 128 in the vicinity of the attachment position of the toner container 50 in the attachment portion 40. Furthermore, the control portion lights off the light emitter 128 when a new toner container 50 is attached. For example, upon detecting that the toner container 50 has been attached, and the connection terminals 95 and the connection terminals 103 have come into contact and are electrically conducted with each other, the control portion lights off the light emitter 128 until the emptiness of the toner container 50 is detected.

Figure 12B:
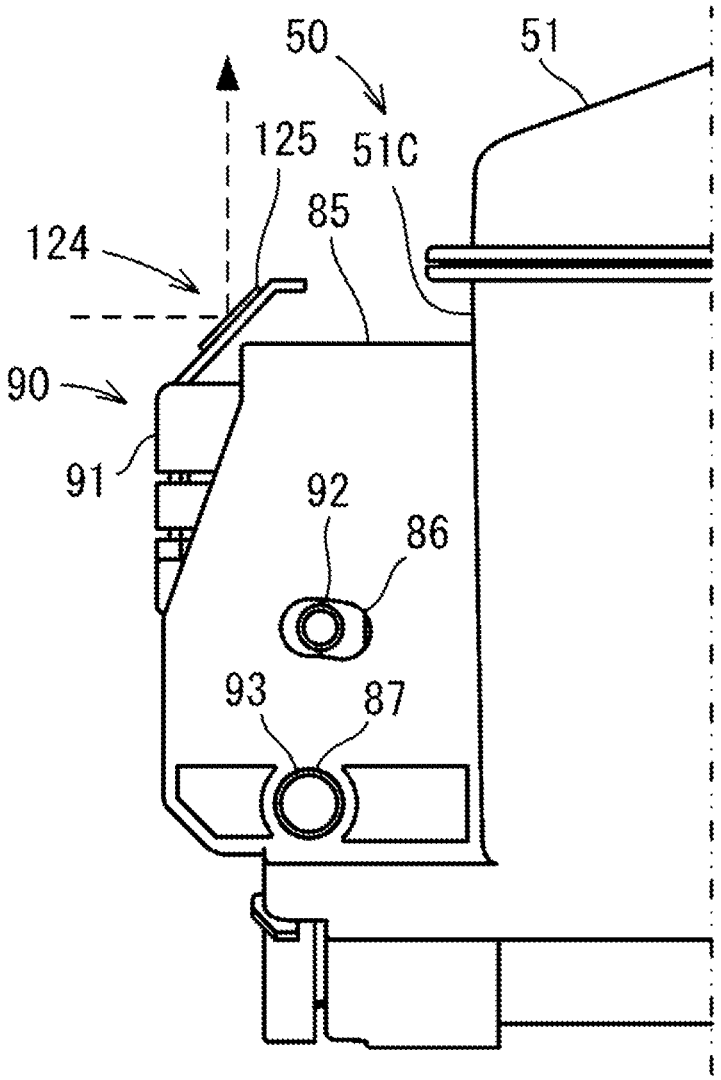
Figure 17:
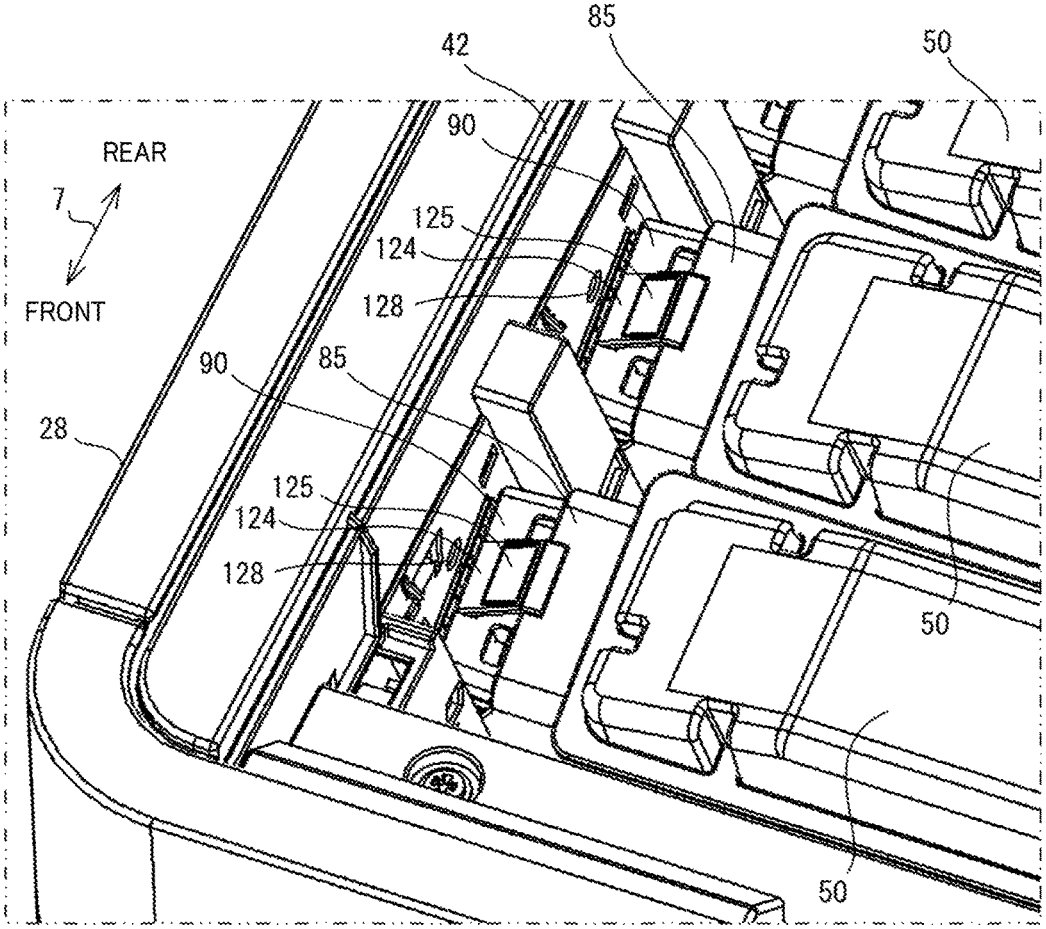
FIG. 17 is a perspective diagram showing a state where a holder of the toner container is attached to the fixing portion of the support plate.

Furthermore, the light emitter 128 irradiates light on the reflection surface 125 in the state where the toner container 50 is attached to the attachment position in the attachment portion 40. For this purpose, as shown in FIG. 17, the reflection surface 125 of the reflection portion 124 is configured to face the emission window 129 of the inner side surface 42A. With this configuration, the light emitted from the light emitter 128 is reflected on the reflection surface 125 and deflected upward. In particular, when the holder 90 is disposed at the adjacent position, the reflection surface 125 reflects the received light upward in the vertical direction as shown in FIG. 12B. This allows the deflected light to go upward. As a result, when the user opens the top cover 28B to replace a toner container 50, the user sees the reflection portion 124 of the toner container 50 shining and can recognize a replacement-target toner container 50 easily. In addition, according to the present embodiment, as described above, the holder 90 receives the pressing force from the connection terminals 103 and is disposed at the adjacent position in a reliable manner in the state where the toner container 50 is attached to the attachment position in the attachment portion 40. This makes it possible for the reflection surface 125 to reflect the received light upward in the vertical direction in a reliable manner.

Figure 18:
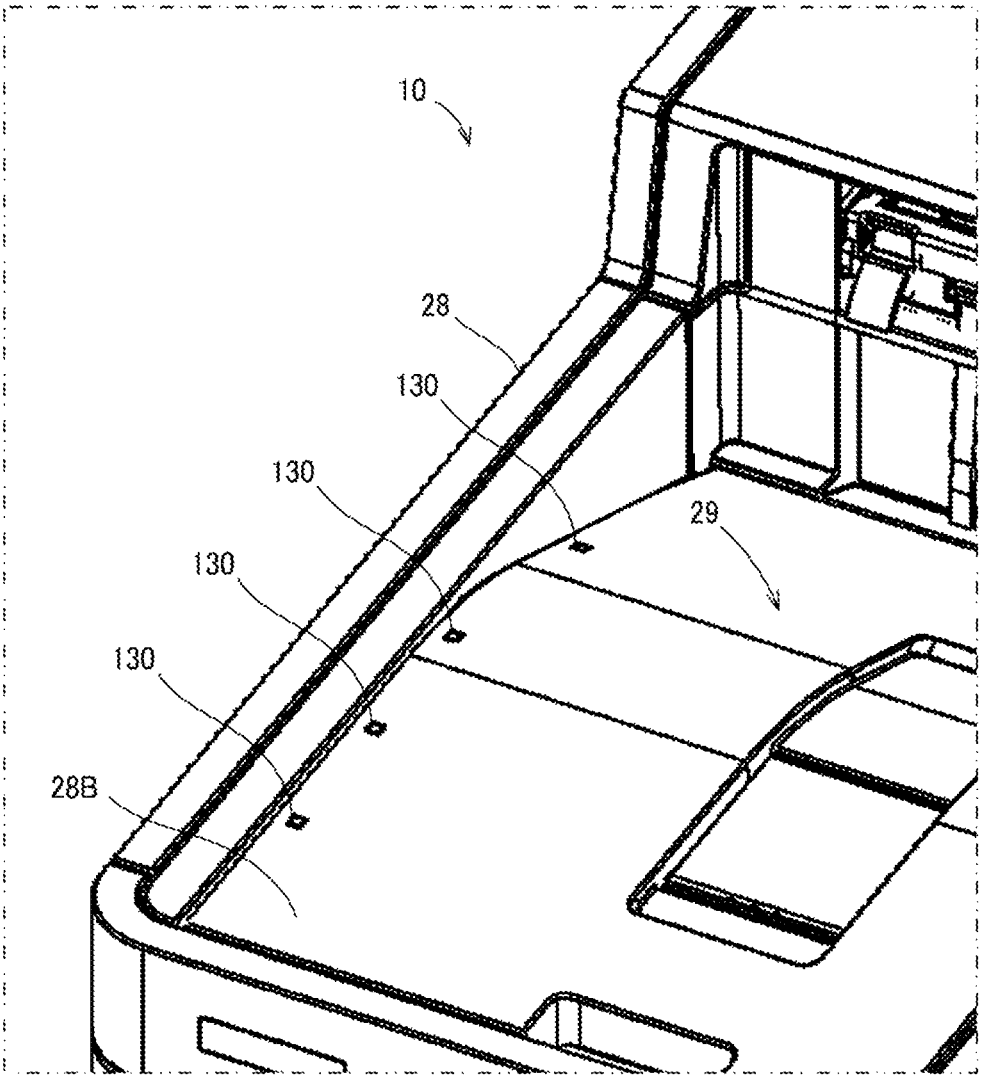
FIG. 18 is a perspective diagram showing light guide windows provided in a top cover.

In addition, as shown in FIG. 18, light guide windows 130 (an example of the window portion) may be provided in the top cover 28B so that light reflected from the reflection surface 125 can be recognized without opening the top cover 28B. The light guide windows 130 are formed by forming through holes in the top cover 28B and sticking transparent sheet for dust prevention thereon. The light guide windows 130 are formed at portions on which light reflected from the reflection surface 125 is irradiated. With this configuration, when the control portion of the image forming apparatus 10 lights a light emitter 128 corresponding to a toner container 50 that has become empty, light from the reflection surface 125 passes through the light guide window 130, and goes out of the top cover 28B. This enables the user to recognize the light from the reflection surface 125 through the light guide windows 130. With this configuration, the user can recognize the replacement-target toner container 50 before opening the top cover 28B.

Figure 19:
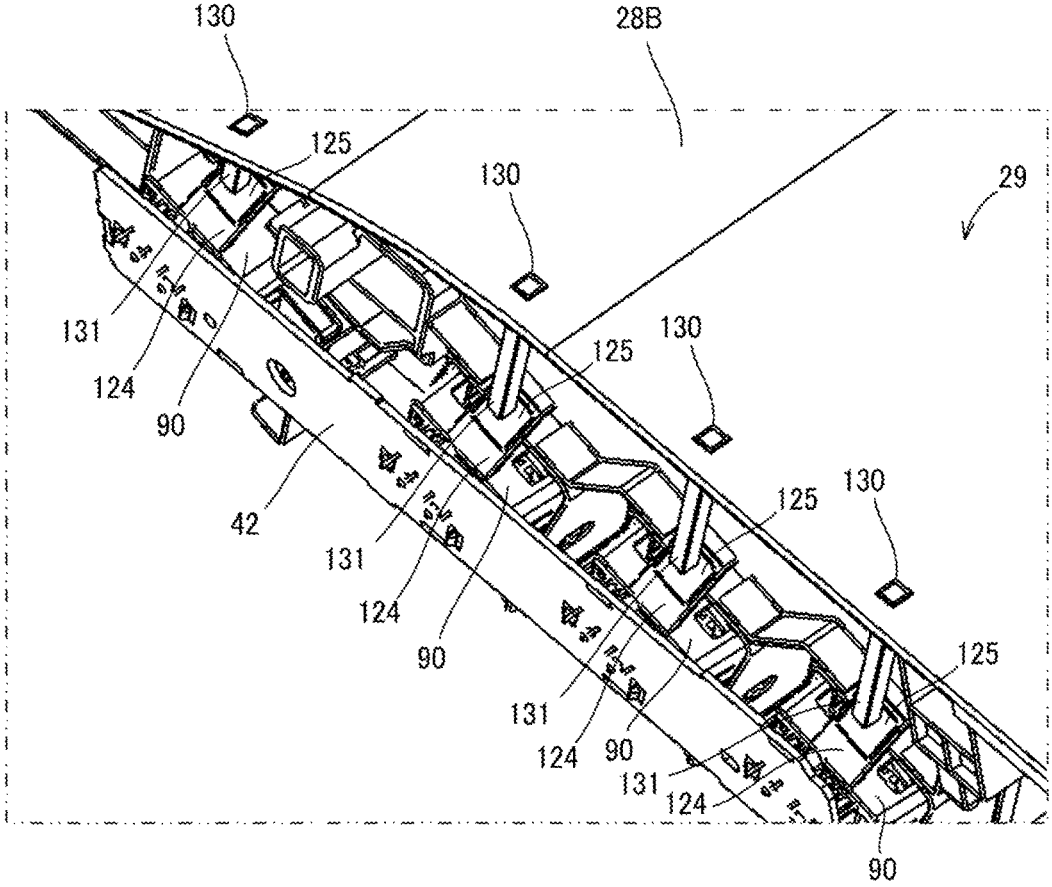
FIG. 19 is a perspective diagram showing light guide members that extend from a reflection portion to the light guide windows provided in the top cover.

In addition, light guide members 131 may be provided as shown in FIG. 19 in order to guide the reflection light from the reflection surface 125 to the light guide windows 130 in a reliable manner, wherein the light guide members 131 guide the light reflected on the reflection surface 125 to the light guide windows 130. Each of the light guide members 131 is a cylindrical member whose inner surface is formed in a mirror finished surface shape that reflects light well. With the light guide members 131, the light from the reflection surface 125 reaches the light guide windows 130 without being decreased due to irregular reflection or the like.

It is noted that in the above-described embodiment, the light emitters 128 are provided on the support plate 42, and the light emitters 121 are provided on the support plate 43. However, the present disclosure is applicable to a configuration where only the light emitters 128 are provided, or a configuration where only the light emitters 121 are provided.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner case that is attached to a case attachment portion of an image forming apparatus, the toner case comprising:

a case main body in which toner is stored;

a light deflector configured to receive light that has been emitted from the case attachment portion toward the case main body, and deflect the light outward;

a toner discharge port provided in the case main body so as to discharge the toner from the case main body;

an opening/closing member configured to open and close the toner discharge port by operating upon receiving a driving force; and a lever provided at one of opposite ends of the case main body in a longitudinal direction and configured to cause the opening/closing member to operate, wherein the case main body is formed to be elongated along a single direction, and the opposite ends thereof in the longitudinal direction are supported by the case attachment portion, and the lever comprises the light deflector.

2. The toner case according to claim 1, wherein the light deflector is a reflection surface configured to receive the light and reflect the light outward.

3. The toner case according to claim 1, wherein the light deflector is a light-transmitting member configured to guide the light inward and emit the light outward.

4. The toner case according to claim 1, wherein the lever is supported by the case main body in such a way as to be displaced between a first operation position corresponding to a closing position of the opening/closing member, and a second operation position corresponding to an opening position of the opening/closing member, and the light deflector receives the light when the lever is disposed at the second operation position.

5. The toner case according to claim 1, further comprising:

a support portion provided in one of the opposite ends of the case main body in the longitudinal direction and supported by the case attachment portion; and a holder supported by the support portion and configured to be displaced in a direction of approaching and separating from the support portion along the longitudinal direction, wherein the holder comprises a second light deflector.

6. The toner case according to claim 5, wherein the holder is supported so as to pivot around a lower portion of the support portion as a pivotal fulcrum in the direction of approaching and separating from the support portion, and the second light deflector is provided in an upper portion of the holder, and as the holder is displaced, the second light deflector is displaced in the direction of approaching and separating.

7. The toner case according to claim 5, wherein the holder is disposed at an adjacent position adjacent to the support portion when the case main body is attached to the case attachment portion, and the second light deflector deflects the light upward in a vertical direction when the holder is disposed at the adjacent position.

8. The toner case according to claim 7, wherein the holder is biased in a direction to be separate from the support portion, and is disposed at the adjacent position by receiving a force from the case attachment portion when the case main body is attached to the case attachment portion.

9. The toner case according to claim 5, wherein the holder includes:

a first contact portion configured to be electrically conducted with an object when contacted therewith, and the case attachment portion includes:

a second contact portion configured to contact the first contact portion in a state where the case main body is attached to the case attachment portion, and is electrically conducted with the first contact portion.

10. An image forming apparatus comprising:

an apparatus main body;

a case attachment portion which is provided in the apparatus main body, and to which the toner case according to claim 1 is attached in a detachable manner; and a light emitting member configured to emit light to the light deflector of the toner case in a state where the toner case is attached to the case attachment portion.

11. The image forming apparatus according to claim 10, wherein the apparatus main body includes:

an upper-surface opening formed in an upper surface of the apparatus main body and through which the toner case is inserted when the toner case is attached; and a cover member covering the upper-surface opening, and the cover member includes:

a window portion configured to allow the light deflected by a second light deflector to pass therethrough and go upward outside the cover member.

12. The image forming apparatus according to claim 11, further comprising:

a light guide member configured to guide the light deflected by the second light deflector to the window portion.

* * * * *